US011598560B2

(12) United States Patent
Yajima

(10) Patent No.: US 11,598,560 B2
(45) Date of Patent: Mar. 7, 2023

(54) REFRIGERANT CYCLE APPARATUS

(71) Applicant: DAIKIN INDUSTRIES, LTD., Osaka (JP)

(72) Inventor: Ryuuzaburou Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/619,099

(22) PCT Filed: Jun. 9, 2020

(86) PCT No.: PCT/JP2020/022690
§ 371 (c)(1),
(2) Date: Dec. 14, 2021

(87) PCT Pub. No.: WO2020/250889
PCT Pub. Date: Dec. 17, 2020

(65) Prior Publication Data

US 2022/0268492 A1 Aug. 25, 2022

(30) Foreign Application Priority Data

Jun. 14, 2019 (JP) ..... JP2019-111466

(51) Int. Cl.
*F25B 13/00* (2006.01)
*F24F 11/36* (2018.01)
(Continued)

(52) U.S. Cl.
CPC ..... *F25B 13/00* (2013.01); *F24F 11/36* (2018.01); *F25B 41/24* (2021.01); *F25B 41/45* (2021.01);
(Continued)

(58) Field of Classification Search
CPC .. F25B 13/00; F25B 49/02; F25B 2313/0233; F25B 2600/2515; F25B 2500/222; F25B 41/24; F25B 49/005; F24F 11/36
See application file for complete search history.

(56) References Cited

U.S. PATENT DOCUMENTS

2013/0227977 A1* 9/2013 Morimoto ..... F25B 13/00 62/190
2014/0033754 A1 2/2014 Hatomura et al.
(Continued)

FOREIGN PATENT DOCUMENTS

CN 107709902 A 2/2018
EP 2631571 A1 8/2013
(Continued)

OTHER PUBLICATIONS

International Preliminary Report on Patentability issued in corresponding International Application No. PCT/JP2020/022690 dated Jun. 9, 2020 (6 pages).
(Continued)

*Primary Examiner* — Henry T Crenshaw
(74) *Attorney, Agent, or Firm* — Osha Bergman Watanabe & Burton LLP

(57) ABSTRACT

A refrigerant cycle apparatus, that circulates a flammable refrigerant in a refrigerant circuit, includes: a gas-side cutoff valve; a liquid-side cutoff valve, where the gas-side cutoff valve and the liquid-side cutoff valve are disposed on opposite sides of a first portion of the refrigerant circuit; a detection unit that detects refrigerant leakage from the first portion into a predetermined space; and a control unit that sets a cutoff state in the gas-side cutoff valve and the liquid-side cutoff valve when the detection unit detects the refrigerant leakage from the first portion into the predetermined space. The cutoff leakage rate at the gas-side cutoff
(Continued)

valve is higher than the cutoff leakage rate at the liquid-side cutoff valve.

8 Claims, 7 Drawing Sheets

(51) Int. Cl.
*F25B 41/24* (2021.01)
*F25B 41/45* (2021.01)
*F25B 49/00* (2006.01)
*F25B 49/02* (2006.01)

(52) U.S. Cl.
CPC ..... *F25B 49/005* (2013.01); *F25B 49/02* (2013.01); *F25B 2313/0233* (2013.01); *F25B 2313/0314* (2013.01); *F25B 2500/222* (2013.01); *F25B 2600/2513* (2013.01); *F25B 2600/2515* (2013.01); *F25B 2700/1931* (2013.01); *F25B 2700/21152* (2013.01)

(56) References Cited

U.S. PATENT DOCUMENTS

| | | | | |
|---|---|---|---|---|
| 2014/0318734 | A1* | 10/2014 | Shimamoto | F25B 45/00 165/11.1 |
| 2015/0121925 | A1* | 5/2015 | Park | F25D 17/065 62/186 |
| 2015/0153085 | A1* | 6/2015 | Nakai | F25B 49/022 62/228.1 |
| 2018/0180338 | A1 | 6/2018 | Honda et al. | |
| 2019/0301750 | A1 | 10/2019 | Suzuki et al. | |
| 2019/0390876 | A1 | 12/2019 | Matsuda et al. | |

FOREIGN PATENT DOCUMENTS

| | | | |
|---|---|---|---|
| EP | 3569944 | A1 | 11/2019 |
| JP | 2015-075272 | A | 4/2015 |
| JP | 2018-112350 | A | 7/2018 |
| JP | 2020-122645 | A | 8/2020 |
| WO | 2012/160598 | A1 | 11/2012 |
| WO | 2018/116404 | A1 | 6/2018 |
| WO | 2018/167811 | A1 | 9/2018 |

OTHER PUBLICATIONS

International Search Report issued in corresponding International Application No. PCT/JP2020/022690, dated Sep. 8, 2020 (5 pages).
Written Opinion issued in corresponding International Application No. PCT/JP2020/022690, dated Sep. 8, 2020 (4 pages).
The Japan Refrigeration and Air Conditioning Industry Association, "Guideline of design construction for ensuring safety against refrigerant leakage from commercial air conditioners using mild flammability (A2L) refrigerants" and Annex A (Prescription) Specifications of safety cutoff valves (JRA GL-16: 2017); Revised on Aug. 21, 2017, and its partial English translation as the concise explanation of relevance (31 pages).
"Report of risk assessment of building multi air conditioners using lower flammability refrigerants", Sep. 20, 2017, and its partial English translation as the concise explanation of relevance (189 pages).
Extended European Search Report issued in corresponding European Application No. 20822389.1, dated Jun. 24, 2022 (7 pages).

* cited by examiner

REFRIGERANT CYCLE APPARATUS

TECHNICAL FIELD

The present disclosure relates to a refrigerant cycle apparatus.

BACKGROUND

In "guideline of design construction for ensuring safety against refrigerant leakage from commercial air conditioners using mild flammability (A2L) refrigerants (JRA GL-16: 2017)", which is a guideline of The Japan Refrigeration and Air Conditioning Industry Association issued on Sep. 1, 2017, "Annex A (Prescription) Specifications of safety cutoff valves" is prepared, and a predetermined specification should be satisfied. One of the specifications of the safety cutoff valves to be satisfied is a closed valve leakage rate. Specifically, when fluid is air and a differential pressure between upstream and downstream of the safety cutoff valve is 1 MPa, 300 ($cm^3$/min) or less is prescribed as the closed valve leakage rate to be satisfied by the safety cutoff valve.

The guideline prescribes that, a safety cutoff valve adopted as a safety measure should be disposed at an appropriate position in a refrigerant circuit to be cut off such that a target living room (room) upon refrigerant leakage has a refrigerant leakage maximum concentration equal to or less than one fourth of a lower flammability limit (LFL). Further, the guideline also prescribes that the refrigerant circuit should be cut off in accordance with a signal from a detector configured to detect refrigerant leakage.

The safety cutoff valve is configured to cut off a refrigerant leaking from a refrigerant circuit into a refrigerant leakage space upon refrigerant leakage. The LFL is a minimum refrigerant concentration specified by ISO 817 and enabling flame propagation in a state where a refrigerant and air are mixed uniformly. The refrigerant leakage maximum concentration is obtained by dividing total refrigerant quantity in a refrigerant circuit by a capacity of a space reserving the refrigerant (a value obtained by multiplying a leakage height by a floor area).

In the guideline, regardless of whether the safety cutoff valve is a gas side safety cutoff valve (hereinafter, a gas-side cutoff valve) or a liquid side safety cutoff valve (hereinafter, a liquid-side cutoff valve), it is required to suppress a closed valve leakage rate to the same leakage rate or less. In general, a gas-refrigerant connection pipe has a larger pipe diameter and a larger gas-side cutoff valve diameter than those of a liquid-refrigerant connection pipe, and thus, when it is assumed that a clearance of a seal portion is uniform, a circumferential length of the seal portion is long. Therefore, a clearance area increases. Accordingly, in a case where an air differential pressure between upstream and downstream is the same, the closed valve leakage rate tends to be higher in the gas-side cutoff valve than in the liquid-side cutoff valve. In order to satisfy the requirement of the guideline, it is necessary to reduce the valve clearance of the gas-side cutoff valve, and thus a manufacturing cost or a purchase cost of the gas-side cutoff valve increases.

CITATION LIST

Non Patent Literature

Guideline of design construction for ensuring safety against refrigerant leakage from commercial air conditioners using mild flammability (A2L) refrigerants (JRA GL-16: 2017; The Japan Refrigeration and Air Conditioning Industry Association) and Annex A (Prescription) Specifications of safety cutoff valves

SUMMARY

A refrigerant cycle apparatus according to one or more embodiments of the present disclosure is a refrigerant cycle apparatus that circulates a flammable refrigerant in a refrigerant circuit. The refrigerant cycle apparatus includes a gas-side cutoff valve, a liquid-side cutoff valve, a detection unit, and a control unit. The gas-side cutoff valve and the liquid-side cutoff valve are provided on opposite sides of a first portion of the refrigerant circuit. The detection unit detects refrigerant leakage from the first portion into a predetermined space. The control unit brings the gas-side cutoff valve and the liquid-side cutoff valve into a cutoff state when the detection unit detects the refrigerant leakage from the first portion into the predetermined space. Cutoff leakage rates at the gas-side cutoff valve and the liquid-side cutoff valve are leakage rates of gas that is in a single gas phase in a standard state at the gas-side cutoff valve and the liquid-side cutoff valve when a differential pressure between upstream and downstream of each of the gas-side cutoff valve and the liquid-side cutoff valve in the cutoff state is a predetermined pressure. The cutoff leakage rate at the gas-side cutoff valve is higher than the cutoff leakage rate at the liquid-side cutoff valve. The cutoff leakage rate is synonymous with a closed valve leakage rate according to the guideline.

In the refrigerant cycle apparatus, a density of the refrigerant to be cut off is different between the gas-side cutoff valve and the liquid-side cutoff valve. The gas-side cutoff valve cuts off the gas refrigerant, and the liquid-side cutoff valve cuts off the liquid refrigerant. Therefore, by reducing the cutoff leakage rate at the liquid-side cutoff valve, even in a case where the cutoff leakage rate at the gas-side cutoff valve is slightly increased, the total rate of refrigerant leakage from the first portion into the predetermined space can be suppressed to a prescribed rate. In view of this, in a refrigerant cycle apparatus according to one or more embodiments, the cutoff leakage rate at the gas-side cutoff valve is made higher than the cutoff leakage rate at the liquid-side cutoff valve. Accordingly, the cost for manufacturing or purchasing the gas-side cutoff valve can be reduced.

In a refrigerant cycle apparatus according to one or more embodiments of the present disclosure, the cutoff leakage rate is a leakage rate of air when a temperature is 20° C. and the predetermined pressure is 1 MPa. The cutoff leakage rate at the gas-side cutoff valve is higher than 300×R ($cm^3$/min). The cutoff leakage rate at the liquid-side cutoff valve is lower than 300×R ($cm^3$/min).

In a refrigerant cycle apparatus according to one or more embodiments of the present disclosure, the cutoff leakage rate at the gas-side cutoff valve is 1.0 times to 2.7 times or less of 300×R ($cm^3$/min). The cutoff leakage rate at the liquid-side cutoff valve is 0.94 times or less of 300×R ($cm^3$/min).

With this configuration, it is possible to suppress the cost for manufacturing or purchasing the gas-side cutoff valve while ensuring safety at the time of refrigerant leakage.

In a refrigerant cycle apparatus according to one or more embodiments of the present disclosure, the cutoff leakage rate at the gas-side cutoff valve is in a range of 1.6 times to 2.7 times of 300×R ($cm^3$/min). The cutoff leakage rate at the liquid-side cutoff valve is in a range of 0.37 times to 0.94 times of 300×R ($cm^3$/min).

With this configuration, it is possible to suppress the cost for manufacturing or purchasing the gas-side cutoff valve while ensuring safety at the time of refrigerant leakage.

In a refrigerant cycle apparatus according to one or more embodiments of the present disclosure, R=1.

In a refrigerant cycle apparatus according to one or more embodiments of the present disclosure, $R=(\rho_{md}\times V_{md}\times A_d)/(C_r\times(2\times\Delta P_r/\rho_{1r})^{0.5}\times A_v\times\rho_{1rl}+A_v\times(2/(\lambda+1))^{((\lambda+1)/2(\lambda-1))}\times(\lambda\times P_{1r}\times\rho_{1rg})^{0.5})$.

$A_v$ is a valve clearance sectional area ($m^2$) of each of the gas-side cutoff valve and the liquid-side cutoff valve in the cutoff state.

$\rho_{1rl}$ is a density ($kg/m^3$) of the refrigerant in a liquid phase.

$\rho_{1rg}$ is a density ($kg/m^3$) of the refrigerant in a gas phase.

$P_{1r}$ is a pressure (MPa) of the refrigerant located upstream of each of the gas-side cutoff valve and the liquid-side cutoff valve.

$\lambda$ is a specific heat ratio of the refrigerant.

$\rho_{md}$ is a density ($kg/m^3$) of a gaseous mixture of the air and the refrigerant passing through a clearance of a door partitioning into inside and outside the predetermined space.

$V_{md}$ is a velocity (m/s) of the gaseous mixture of the air and the refrigerant passing through the clearance of the door partitioning into inside and outside the predetermined space.

$A_d$ is an area ($m^2$) of the clearance of the door partitioning into inside and outside the predetermined space.

$\Delta P_r$ is a pressure difference (Pa) between inside and outside a hole where the refrigerant leaks.

$C_r$ is a flow rate coefficient of the refrigerant when the refrigerant in the liquid phase passes through the hole where the refrigerant leaks.

$C_r$ is 0.6.

In the refrigerant cycle apparatus according to one or more embodiments, in an exemplary case where R32 is adopted as the refrigerant, the first portion of the refrigerant circuit is positioned at a height of 2.2 m from a floor of the predetermined space, and one fourth of a lower flammability limit (LFL) specified by ISO 817 corresponds to a tolerable refrigerant concentration in the predetermined space, R=1.96.

With this configuration, the cost for manufacturing or purchasing the gas-side cutoff valve can be further suppressed.

In a refrigerant cycle apparatus according to one or more embodiments of the present disclosure, R is determined based on at least one of a tolerable average concentration, a leakage height, and a type of the refrigerant. The tolerable average concentration is an average concentration of the refrigerant leaking into the predetermined space. The tolerable average concentration is a concentration in a range where it is recognized that there is no risk of combustion of the refrigerant leaking into the predetermined space. The leakage height is a position of the first portion in the predetermined space when the refrigerant leaks into the predetermined space.

With this configuration, since R is calculated in consideration of the size of the predetermined space equipped with the refrigerant cycle apparatus, an installation position of the refrigerant cycle apparatus, and the type of the refrigerant, it is possible to obtain specifications of the cutoff leakage rates to be satisfied by the gas-side cutoff valve and the liquid-side cutoff valve.

In a refrigerant cycle apparatus according to one or more embodiments of the present disclosure, the flammable refrigerant may be a mildly flammable refrigerant determined as "Class 2L" according to ANSI/ASHRAE Standard 34-2013. The flammable refrigerant may be a less flammable refrigerant determined as "Class 2" according to ANSI/ASHRAE Standard 34-2013. The flammable refrigerant may be a highly flammable refrigerant determined as "Class 3" according to ANSI/ASHRAE Standard 34-2013.

DETAILED DESCRIPTION (1) Configuration of Air Conditioner

Figure 1:
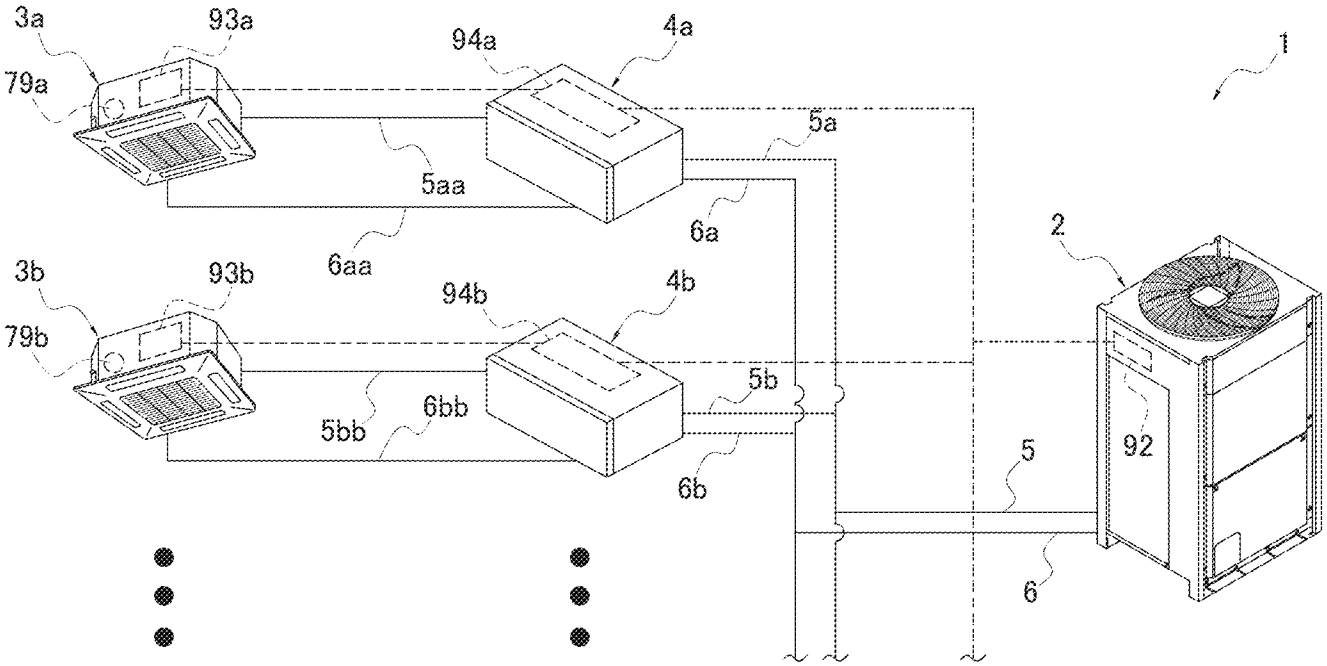
FIG. 1 is a diagram illustrating a schematic configuration of an air conditioner as a refrigerant cycle apparatus according to one or more embodiments.
Figure 2:
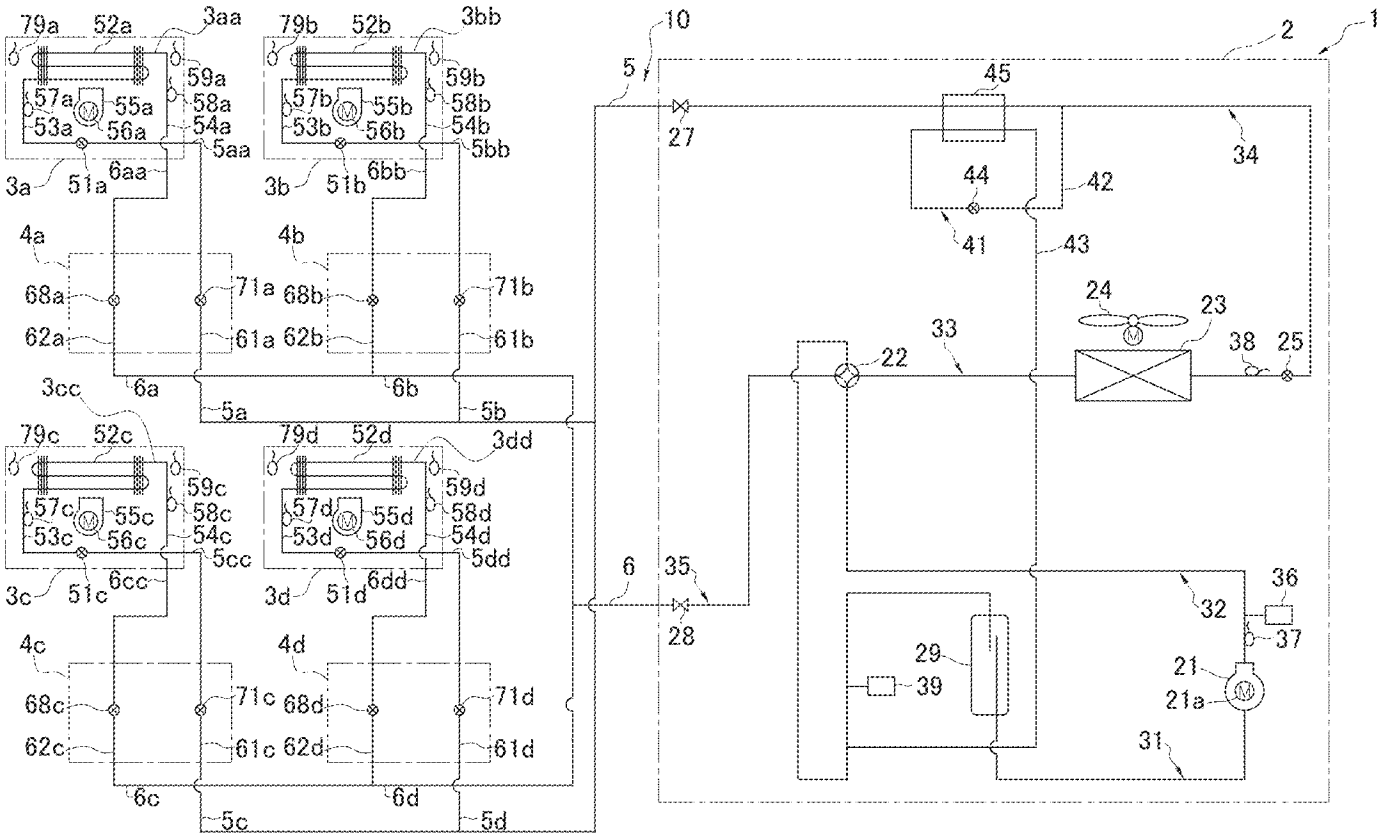
FIG. 2 is a diagram illustrating a refrigerant circuit of the air conditioner.

As illustrated in FIG. 1 and FIG. 2, an air conditioner 1 as a refrigerant cycle apparatus according to one or more embodiments is configured to cool or heat a room (predetermined space) in an architecture such as a building by means of a vapor compression refrigeration cycle. The air conditioner 1 mainly includes a heat source-side unit 2, a plurality of utilization-side units 3*a*, 3*b*, 3*c*, and 3*d*, relay units 4*a*, 4*b*, 4*c*, and 4*d* connected to the utilization-side units 3*a*, 3*b*, 3*c*, and 3*d*, refrigerant connection pipes 5 and 6, and a control unit 19 (see FIG. 4). The plurality of utilization-side units 3*a*, 3*b*, 3*c*, and 3*d* is connected in parallel to the heat source-side unit 2. The refrigerant connection pipes 5 and 6 connect the heat source-side unit 2 and the utilization-side units 3*a*, 3*b*, 3*c*, and 3*d* via the relay units 4*a*, 4*b*, 4*c*, and 4*d*. The control unit 19 controls constituent devices of the heat source-side unit 2, the utilization-side units 3*a*, 3*b*, 3*c*, and 3*d*, and the relay units 4*a*, 4*b*, 4*c*, and 4*d*.

A refrigerant circuit 10 is filled with R32. When a flammable refrigerant leaks from the refrigerant circuit 10 into a room (predetermined space) SP (see FIG. 3) which is thus increased in refrigerant concentration, a combustion accident may be caused. Such a combustion accident needs to be prevented.

The utilization-side units 3*a*, 3*b*, 3*c*, and 3*d* in the air conditioner 1 are switched to cooling operation or heating operation by a switching mechanism 22 of the heat source-side unit 2.

(1-1) Refrigerant Connection Pipe

A liquid-refrigerant connection pipe 5 mainly includes a combined pipe portion extending from the heat source-side unit 2, first branch pipe portions 5*a*, 5*b*, 5*c*, and 5*d*, which are branched into a plurality of (here, four) pipes in front of the relay units 4*a*, 4*b*, 4*c*, and 4*d*, and second branch pipe portions 5*aa*, 5*bb*, 5*cc*, and 5*dd* connecting the relay units 4*a*, 4*b*, 4*c*, and 4*d* to the utilization-side units 3*a*, 3*b*, 3*c*, and 3*d*, respectively.

A gas-refrigerant connection pipe 6 mainly includes a combined pipe portion extending from the heat source-side unit 2, first branch pipe portions 6*a*, 6*b*, 6*c*, and 6*d*, which are branched into a plurality of (here, four) pipes in front of the relay units 4*a*, 4*b*, 4*c*, and 4*d*, and second branch pipe portions 6*aa*, 6*bb*, 6*cc*, and 6*dd* connecting the relay units 4*a*, 4*b*, 4*c*, and 4*d* to the utilization-side units 3*a*, 3*b*, 3*c*, and 3*d*, respectively.

(1-2) Utilization-Side Unit

The utilization-side units 3*a*, 3*b*, 3*c*, and 3*d* are installed in a room of a building or the like. As described above, the utilization-side units 3*a*, 3*b*, 3*c*, and 3*d* are connected to the heat source-side unit 2 via the liquid-refrigerant connection pipe 5, the gas-refrigerant connection pipe 6, and the relay units 4*a*, 4*b*, 4*c*, and 4*d*, and constitute part of the refrigerant circuit 10.

The utilization-side units 3*a*, 3*b*, 3*c*, and 3*d* will be described next in terms of their configurations. Note that since the configuration of the utilization-side unit 3*a* is similar to the configurations of the utilization-side units 3*b*, 3*c*, and 3*d*, only the configuration of the utilization-side unit 3*a* will be described here. For the configurations of the utilization-side units 3*b*, 3*c*, and 3*d*, instead of the subscript "a" indicating each part of the utilization-side unit 3*a*, the subscript "b", "c", or "d" is added, respectively, and the description of each part will be omitted.

The utilization-side unit 3*a* mainly includes a utilization-side expansion valve 51*a* and a utilization-side heat exchanger 52*a*. In addition, the utilization-side unit 3*a* includes a utilization-side liquid refrigerant pipe 53*a* that connects a liquid-side end of the utilization-side heat exchanger 52*a* to the liquid-refrigerant connection pipe 5 (here, the branch pipe portion 5*aa*), and a utilization-side gas refrigerant pipe 54*a* that connects a gas-side end of the utilization-side heat exchanger 52*a* to the gas-refrigerant connection pipe 6 (here, the second branch pipe portion 6*aa*). The utilization-side liquid refrigerant pipe 53*a*, the utilization-side expansion valve 51*a*, the utilization-side heat exchanger 52*a*, and the utilization-side gas refrigerant pipe 54*a* constitute a utilization circuit 3*aa* (first portion) of the utilization-side unit 3*a*.

The utilization-side expansion valve 51*a* is an electrically powered expansion valve configured to decompress a refrigerant as well as adjusting a flow rate of the refrigerant flowing in the utilization-side heat exchanger 52*a*, and is provided on the utilization-side liquid refrigerant pipe 53*a*.

The utilization-side heat exchanger 52*a* functions as a refrigerant evaporator to cool indoor air, or functions as a refrigerant radiator to heat indoor air. Here, the utilization-side unit 3*a* includes a utilization-side fan 55*a*. The utilization-side fan 55*a* supplies the utilization-side heat exchanger 52*a* with indoor air as a cooling source or a heating source for the refrigerant flowing in the utilization-side heat exchanger 52*a*. The utilization-side fan 55*a* is driven by a utilization-side fan motor 56*a*.

The utilization-side unit 3*a* includes various sensors. Specifically, the utilization-side unit 3*a* includes a utilization-side heat exchange liquid-side sensor 57*a* configured to detect a refrigerant temperature at the liquid-side end of the utilization-side heat exchanger 52*a*, a utilization-side heat exchange gas-side sensor 58*a* configured to detect a refrigerant temperature at the gas side end of the utilization-side heat exchanger 52*a*, and an indoor air sensor 59*a* configured to detect a temperature of indoor air sucked into the utilization-side unit 3*a*. The utilization-side unit 3*a* further includes a refrigerant leakage detection unit 79*a* configured to detect refrigerant leakage. Examples of the refrigerant leakage detection unit 79*a* can include a semiconductor gas sensor and a detection unit configured to detect a rapid decrease in refrigerant pressure in the utilization-side unit 3*a*. The semiconductor gas sensor adopted as the refrigerant leakage detection unit 79*a* is connected to a utilization-side control unit 93*a* (see FIG. 4). When the detection unit configured to detect a rapid decrease in refrigerant pressure is adopted as the refrigerant leakage detection unit 79*a*, a pressure sensor is installed on a refrigerant pipe, and a detection algorithm for determination of refrigerant leakage based on a change in sensor value is provided in the utilization-side control unit 93*a*.

Here, the refrigerant leakage detection unit 79*a* is provided in the utilization-side unit 3*a*. However, the present disclosure is not limited to this configuration, and the refrigerant leakage detection unit 79*a* may alternatively be provided in a remote controller configured to operate the utilization-side unit 3*a*, in an indoor space as an air conditioning target of the utilization-side unit 3*a*, or the like. For example, the detection unit 79*a* may be installed in the vicinity of a lower portion of a blow-out port through which the refrigerant leaks from the utilization-side unit 3*a* to the predetermined space SP, or at a position immediately below the utilization-side unit 3*a* or the blow-out port within 10 m from a joint portion of an indoor pipe in a horizontal direction in the predetermined space SP. In a case where the utilization-side expansion valve 51*a* originally installed in the utilization-side unit 3*a* has a full-close function, the expansion valve may be used as a liquid-side cutoff valve 71*a*.

(1-3) Heat Source-Side Unit

The heat source-side unit 2 is installed outside an architecture such as a building, for example, on a roof or on the ground. As described above, the heat source-side unit 2 is connected to the utilization-side units 3*a*, 3*b*, 3*c*, and 3*d* via the liquid-refrigerant connection pipe 5, the gas-refrigerant connection pipe 6, and the relay units 4*a*, 4*b*, 4*c*, and 4*d*, to constitute part of the refrigerant circuit 10.

The heat source-side unit 2 mainly includes a compressor 21 and a heat source-side heat exchanger 23. In addition, the heat source-side unit 2 includes the switching mechanism 22 as a cooling and heating switching mechanism for switching between a cooling operation state in which the heat source-side heat exchanger 23 functions as a refrigerant radiator and the utilization-side heat exchangers 52*a*, 52*b*, 52*c*, and 52*d* function as refrigerant evaporators, and a heating operation state in which the heat source-side heat exchanger 23 functions as a refrigerant evaporator and the utilization-side heat exchangers 52*a*, 52*b*, 52*c*, and 52*d* function as refrigerant radiators. The switching mechanism 22 and a suction side of the compressor 21 are connected via a sucked refrigerant pipe 31. The sucked refrigerant pipe 31 is provided with an accumulator 29 that temporarily accumulates the refrigerant sucked into the compressor 21. The switching mechanism 22 and a discharge side of the compressor 21 are connected via a discharged refrigerant pipe 32. The switching mechanism 22 and a gas-side end of the heat source-side heat exchanger 23 are connected via a first heat source-side gas refrigerant pipe 33. The liquid-refrigerant connection pipe 5 and a liquid-side end of the heat source-side heat exchanger 23 are connected via a heat source-side liquid refrigerant pipe 34. The heat source-side liquid refrigerant pipe 34 and the liquid-refrigerant connection pipe 5 are connected at a portion provided with a liquid-side shutoff valve 27. The switching mechanism 22 and the gas-refrigerant connection pipe 6 are connected via a second heat source-side gas refrigerant pipe 35. The second heat source-side gas refrigerant pipe 35 and the gas-refrigerant connection pipe 6 are connected at a portion provided with a gas-side shutoff valve 28. The liquid-side shutoff valve 27 and the gas-side shutoff valve 28 are configured to be manually opened and closed. During operation, the liquid-side shutoff valve 27 and the gas-side shutoff valve 28 are in an open state.

The compressor 21 is a device for compressing the refrigerant. For example, a compressor having a closed structure in which a positive displacement compression element (not illustrated) such as a rotary type or a scroll type is driven to rotate by a compressor motor 21*a* is used.

The switching mechanism 22 is configured to switch a flow of the refrigerant in the refrigerant circuit 10, and is exemplarily implemented by a four-way switching valve. In a case where the heat source-side heat exchanger 23 functions as a refrigerant radiator and the utilization-side heat exchangers 52*a*, 52*b*, 52*c*, and 52*d* each function as a refrigerant evaporator (hereinafter, referred to as the "cooling operation state"), the switching mechanism 22 connects the discharge side of the compressor 21 and the gas side of the heat source-side heat exchanger 23 (see a solid line for the switching mechanism 22 in FIG. 2). In another case where the heat source-side heat exchanger 23 functions as a refrigerant evaporator and the utilization-side heat exchangers 52*a*, 52*b*, 52*c*, and 52*d* each function as a refrigerant radiator (hereinafter, referred to as the "heating operation state"), the switching mechanism 22 connects the suction side of the compressor 21 and the gas side of the heat source-side heat exchanger 23 (see a broken line for the first switching mechanism 22 in FIG. 2).

The heat source-side heat exchanger 23 functions as a refrigerant radiator, or functions as a refrigerant evaporator. The heat source-side unit 2 includes a heat source-side fan 24. The heat source-side fan 24 sucks outdoor air into the heat source-side unit 2, causes the sucked outdoor air to exchange heat with the refrigerant in the heat source-side heat exchanger 23, and discharges the outdoor air having exchanged heat to the outside. The heat source-side fan 24 is driven by a heat source-side fan motor.

During the cooling operation, the air conditioner 1 causes the refrigerant to flow from the heat source-side heat exchanger 23 to the utilization-side heat exchangers 52*a*, 52*b*, 52*c*, and 52*d* each functioning as a refrigerant evaporator via the liquid-refrigerant connection pipe 5 and the relay units 4*a*, 4*b*, 4*c*, and 4*d*. During the heating operation, the air conditioner 1 causes the refrigerant to flow from the compressor 21 to the utilization-side heat exchangers 52*a*, 52*b*, 52*c*, and 52*d* each functioning as a refrigerant radiator via the gas-refrigerant connection pipe 6 and the relay units 4*a*, 4*b*, 4*c*, and 4*d*. During the cooling operation, the switching mechanism 22 switches to the cooling operation state where the heat source-side heat exchanger 23 functions as a refrigerant radiator and the refrigerant flows from the heat source-side unit 2 to the utilization-side units 3*a*, 3*b*, 3*c*, and 3*d* via the liquid-refrigerant connection pipe 5 and the relay units 4*a*, 4*b*, 4*c*, and 4*d*. During the heating operation, the switching mechanism 22 switches to the heating operation state where the refrigerant flows from the utilization-side units 3*a*, 3*b*, 3*c*, and 3*d* to the heat source-side unit 2 via the liquid-refrigerant connection pipe 5 and the relay units 4*a*, 4*b*, 4*c*, and 4*d* and the heat source-side heat exchanger 23 functions as a refrigerant evaporator.

The heat source-side liquid refrigerant pipe 34 is provided with a heat source-side expansion valve 25 in this case. The heat source-side expansion valve 25 is an electrically powered expansion valve configured to decompress the refrigerant during the heating operation, and is provided on the heat source-side liquid refrigerant pipe 34, at a portion adjacent to the liquid-side end of the heat source-side heat exchanger 23.

The heat source-side liquid refrigerant pipe 34 is connected to a refrigerant return pipe 41 and is provided with a refrigerant cooler 45. The refrigerant return pipe 41 causes part of the refrigerant flowing in the heat source-side liquid refrigerant pipe 34 to branch to be sent to the compressor 21. The refrigerant cooler 45 cools the refrigerant flowing in the heat source-side liquid refrigerant pipe 34 by means of the refrigerant flowing in the refrigerant return pipe 41. The heat source-side expansion valve 25 is provided on the heat source-side liquid refrigerant pipe 34, at a portion closer to the heat source-side heat exchanger 23 than to the refrigerant cooler 45.

The refrigerant return pipe 41 is a refrigerant pipe causing the refrigerant branching from the heat source-side liquid refrigerant pipe 34 to be sent to the suction side of the compressor 21. The refrigerant return pipe 41 mainly includes a refrigerant return inlet pipe 42 and a refrigerant return outlet pipe 43. The refrigerant return inlet pipe 42 causes part of the refrigerant flowing in the heat source-side liquid refrigerant pipe 34 to branch from a portion between the liquid-side end of the heat source-side heat exchanger 23 and the liquid-side shutoff valve 27 (a portion between the heat source-side expansion valve 25 and the refrigerant cooler 45 in this case) and be sent to an inlet, adjacent to the refrigerant return pipe 41, of the refrigerant cooler 45. The refrigerant return inlet pipe 42 is provided with a refrigerant return expansion valve 44. The refrigerant return expansion valve 44 decompresses the refrigerant flowing in the refrigerant return pipe 41 as well as adjusting a flow rate of the refrigerant flowing in the refrigerant cooler 45. The refrigerant return expansion valve 44 is implemented by an electrically powered expansion valve. The refrigerant return outlet pipe 43 causes the refrigerant to be sent from an outlet, adjacent to the refrigerant return pipe 41, of the refrigerant cooler 45 to the sucked refrigerant pipe 31. The refrigerant return outlet pipe 43 of the refrigerant return pipe 41 is connected to the sucked refrigerant pipe 31, at a portion adjacent to an inlet of the accumulator 29. The refrigerant cooler 45 cools the refrigerant flowing in the heat source-side liquid refrigerant pipe 34 by means of the refrigerant flowing in the refrigerant return pipe 41.

The heat source-side unit 2 includes various sensors. Specifically, the heat source-side unit 2 includes a discharge pressure sensor 36 configured to detect a pressure (discharge pressure) of the refrigerant discharged from the compressor 21, a discharge temperature sensor 37 configured to detect a temperature (discharge temperature) of the refrigerant discharged from the compressor 21, and a suction pressure sensor 39 configured to detect a pressure (suction pressure) of the refrigerant sucked into the compressor 21. The heat source-side unit 2 further includes a heat source-side heat exchange liquid-side sensor 38 configured to detect a temperature (heat source-side heat exchange outlet temperature) of the refrigerant at the liquid-side end of the heat source-side heat exchanger 23.

(1-4) Relay Unit

The relay units 4*a*, 4*b*, 4*c*, and 4*d* are installed in a space SP1 behind a ceiling of the room (predetermined space) SP (see FIG. 3) in an architecture such as a building. The relay units 4*a*, 4*b*, 4*c*, and 4*d* are interposed between the utilization-side units 3*a*, 3*b*, 3*c*, and 3*d* and the heat source-side unit 2, respectively, together with the liquid-refrigerant connection pipe 5 and the gas-refrigerant connection pipe 6, and constitute part of the refrigerant circuit 10. The relay units 4*a*, 4*b*, 4*c*, and 4*d* may be disposed near the utilization-side units 3*a*, 3*b*, 3*c*, and 3*d*, respectively. Alternatively, the relay units 4*a*, 4*b*, 4*c*, and 4*d* may be disposed away from the utilization-side units 3*a*, 3*b*, 3*c*, and 3*d*, or may be disposed together in one location.

The relay units 4*a*, 4*b*, 4*c*, and 4*d* will be described next in terms of their configurations. The relay unit 4*a* and the relay units 4*b*, 4*c*, and 4*d* are configured similarly. The configuration of only the relay unit 4*a* will thus be described herein. For the configurations of the relay units 4*b*, 4*c*, and 4*d*, instead of the subscript "a" indicating each part of the relay unit 4*a*, the subscript "b", "c", or "d" is added, respectively, and the description of each part will be omitted.

The relay unit 4*a* mainly includes a liquid connecting pipe 61*a* and a gas connecting pipe 62*a*.

The liquid connecting pipe 61*a* has one end connected to the first branch pipe portion 5*a* of the liquid-refrigerant connection pipe 5, and the other end connected to the second branch pipe portion 5*aa* of the liquid-refrigerant connection pipe 5. The liquid connecting pipe 61*a* is provided with a liquid-side cutoff valve 71*a*. The liquid-side cutoff valve 71*a* is implemented by an electrically powered expansion valve.

The gas connecting pipe 62*a* has one end connected to the first branch pipe portion 6*a* of the gas-refrigerant connection pipe 6, and the other end connected to the second branch pipe portion 6*aa* of the gas-refrigerant connection pipe 6. The gas connecting pipe 62*a* is provided with a gas-side cutoff valve 68*a*. The gas-side cutoff valve 68*a* is implemented by an electrically powered expansion valve.

The liquid-side cutoff valve 71*a* and the gas-side cutoff valve 68*a* are fully opened when the cooling operation or heating operation is performed.

(1-5) Control Unit

Figure 4:
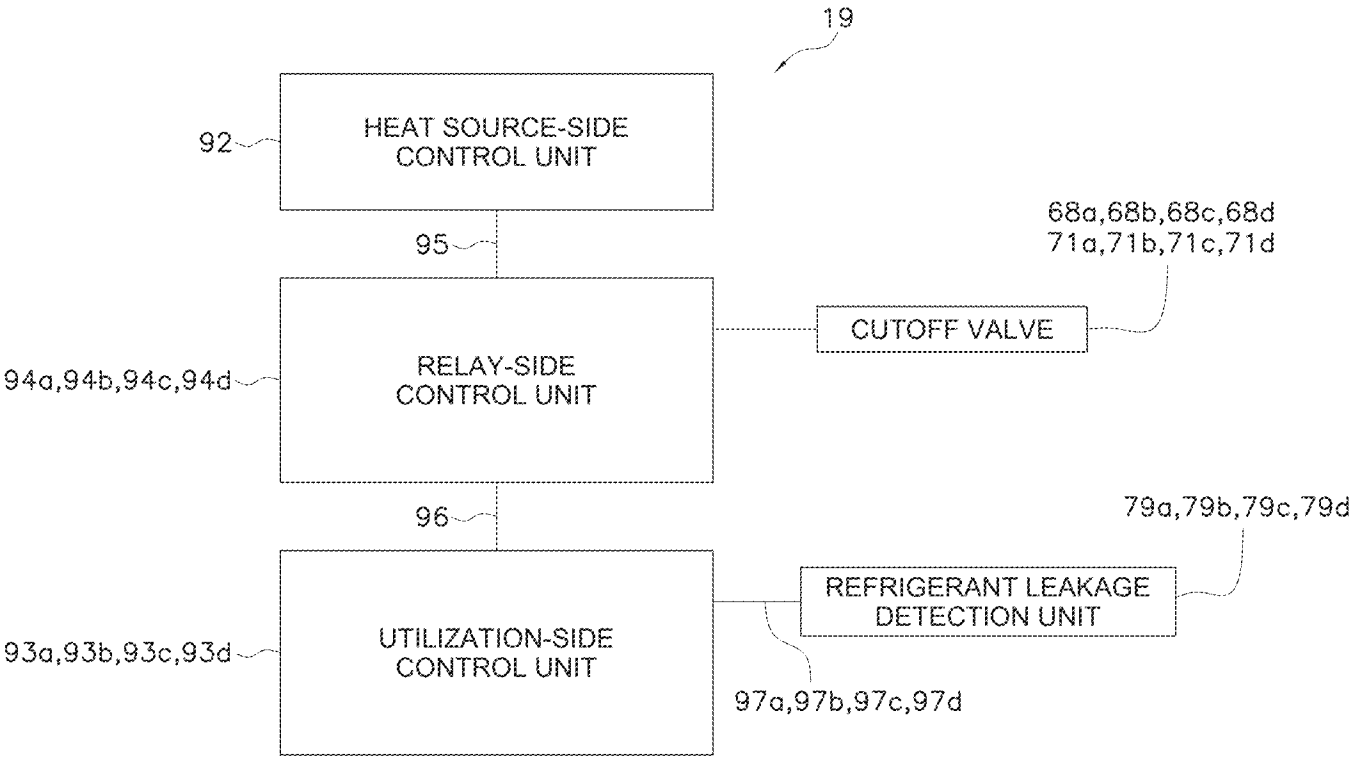
FIG. 4 is a control block diagram of the air conditioner.

As illustrated in FIG. 4, the control unit 19 includes a heat source-side control unit 92, relay-side control units 94*a*, 94*b*, 94*c*, and 94*d*, and utilization-side control units 93*a*, 93*b*, 93*c*, and 93*d*, which are connected via transmission lines 95 and 96. The heat source-side control unit 92 controls constituent devices of the heat source-side unit 2. The relay-side control units 94*a*, 94*b*, 94*c*, and 94*d* control constituent devices of the relay units 4*a*, 4*b*, 4*c*, and 4*d*, respectively. The utilization-side control units 93*a*, 93*b*, 93*c*, and 93*d* control constituent devices of the utilization-side units 3*a*, 3*b*, 3*c*, and 3*d*, respectively. The heat source-side control unit 92 provided in the heat source-side unit 2, the relay-side control units 94*a*, 94*b*, 94*c*, and 94*d* provided in the relay units 4*a*, 4*b*, 4*c*, and 4*d*, and the utilization-side control units 93*a*, 93*b*, 93*c*, and 93*d* provided in the utilization-side units 3*a*, 3*b*, 3*c*, and 3*d*, respectively, can exchange information, such as a control signal, with each other via the transmission lines 95 and 96.

The heat source-side control unit 92 includes a control board mounted with electric components such as a microcomputer and a memory, and is connected to various constituent devices 21, 22, 24, 25, and 44 and various sensors 36, 37, 38, and 39 in the heat source-side unit 2. The relay-side control units 94*a*, 94*b*, 94*c*, and 94*d* each include a control board mounted with electric components such as a microcomputer and a memory, and are connected to gas-side cutoff valves 68*a* to 68*d* and liquid-side cutoff valves 71*a* to 71*d* of the relay units 4*a*, 4*b*, 4*c*, and 4*d*. The relay-side control units 94*a*, 94*b*, 94*c*, and 94*d* and the heat source-side control unit 92 are connected via the first transmission line 95. The utilization-side control units 93*a*, 93*b*, 93*c*, and 93*d* each include a control board mounted with electric components such as a microcomputer and a memory, and are connected to various constituent devices 51*a* to 51*d* and 55*a* to 55*d* of the utilization-side units 3*a*, 3*b*, 3*c*, and 3*d* and various sensors 57*a* to 57*d*, 58*a* to 58*d*, 59*a* to 59*d*, and 79*a* to 79*d*. Assume that the refrigerant leakage detection units 79*a*, 79*b*, 79*c*, and 79*d* are connected to the utilization-side control units 93*a*, 93*b*, 93*c*, and 93*d* via wires 97*a*, 97*b*, 97*c*, and 97*d*. The utilization-side control units 93*a*, 93*b*, 93*c*, and 93*d* and the relay-side control units 94*a*, 94*b*, 94*c*, and 94*d* are connected via the second transmission line 96.

In this manner, the control unit 19 controls operation of the entire air conditioner 1. Specifically, based on detection signals of various sensors 36, 37, 38, 39, 57*a* to 57*d*, 58*a* to 58*d*, 59*a* to 59*d*, 79*a* to 79*d*, and the like as described above, the control unit 19 controls various constituent devices 21, 22, 24, 25, 44, 51*a* to 51*d*, 55*a* to 55*d*, 68*a* to 68*d*, and 71*a* to 71*d* of the air conditioner 1 (here, the heat source-side unit 2, the utilization-side units 3*a*, 3*b*, 3*c*, and 3*d*, and the relay units 4*a*, 4*b*, 4*c*, and 4*d*).

(2) Basic Operation of Air Conditioner

The air conditioner 1 will be described next in terms of its basic operation. As described above, the basic operation of the air conditioner 1 includes the cooling operation and the heating operation. Note that the basic operation of the air conditioner 1 described below is performed by the control unit 19 that controls the constituent devices of the air conditioner 1 (the heat source-side unit 2, the utilization-side units 3*a*, 3*b*, 3*c*, and 3*d*, and the relay units 4*a*, 4*b*, 4*c*, and 4*d*).

(2-1) Cooling Operation

During the cooling operation in an exemplary case where all the utilization-side units 3*a*, 3*b*, 3*c*, and 3*d* perform the cooling operation (an operation by each one of the utilization-side heat exchangers 52*a*, 52*b*, 52*c*, and 52*d* functioning as a refrigerant evaporator and the heat source-side heat exchanger 23 functioning as a refrigerant radiator), the switching mechanism 22 switches to the cooling operation state (the state depicted by the solid line for the switching mechanism 22 in FIG. 2) to drive the compressor 21, the heat source-side fan 24, and the utilization-side fans 55*a*, 55*b*, 55*c*, and 55*d*. Furthermore, the liquid-side cutoff valves 71*a*, 71*b*, 71*c*, and 71*d* and the gas-side cutoff valves 68*a*, 68*b*, 68*c*, and 68*d* of the relay units 4*a*, 4*b*, 4*c*, and 4*d* are fully opened.

Here, various devices of the utilization-side units 3*a*, 3*b*, 3*c*, and 3*d* are operated by the utilization-side control units 93*a*, 93*b*, 93*c*, and 93*d*, respectively. The utilization-side control units 93*a*, 93*b*, 93*c*, and 93*d* transmit information indicating that the utilization-side units 3*a*, 3*b*, 3*c*, and 3*d* will perform the cooling operation to the heat source-side control unit 92 and the relay-side control units 94*a*, 94*b*, 94*c*, and 94*d* via the transmission lines 95 and 96. Various devices of the heat source-side unit 2 and the relay units 4*a*, 4*b*, 4*c*, and 4*d* are operated by the heat source-side control unit 92 and the relay-side control units 94*a*, 94*b*, 94*c*, and 94*d* that receive the information from the utilization-side units 3*a*, 3*b*, 3*c*, and 3*d*, respectively.

During the cooling operation, a high-pressure refrigerant discharged from the compressor 21 is sent to the heat source-side heat exchanger 23 via the switching mechanism 22. The refrigerant sent to the heat source-side heat exchanger 23 condenses by being cooled by exchanging heat with outdoor air supplied by the heat source-side fan 24 in the heat source-side heat exchanger 23 that functions as a refrigerant radiator. This refrigerant flows out of the heat source-side unit 2 via the heat source-side expansion valve 25, the refrigerant cooler 45, and the liquid-side shutoff valve 27. In the refrigerant cooler 45, the refrigerant flowing in the refrigerant return pipe 41 cools the refrigerant flowing out of the heat source-side unit 2.

The refrigerant flowing out of the heat source-side unit 2 is branched to be sent to the relay units 4*a*, 4*b*, 4*c*, and 4*d* via the liquid-refrigerant connection pipe 5 (the combined pipe portion and the first branch pipe portions 5*a*, 5*b*, 5*c*, and 5*d*). The refrigerant sent to the relay units 4*a*, 4*b*, 4*c*, and 4*d* flows out of the relay units 4*a*, 4*b*, 4*c*, and 4*d* through the liquid-side cutoff valves 71*a*, 71*b*, 71*c*, and 71*d*, respectively.

The refrigerant flowing out of the relay units 4*a*, 4*b*, 4*c*, and 4*d* is sent to the utilization-side units 3*a*, 3*b*, 3*c*, and 3*d* through the second branch pipe portions 5*aa*, 5*bb*, 5*cc*, and 5*dd* (portions of the liquid-refrigerant connection pipe 5 that connects the relay units 4*a*, 4*b*, 4*c*, and 4*d* to the utilization-side units 3*a*, 3*b*, 3*c*, and 3*d*), respectively. The refrigerant sent to the utilization-side units 3*a*, 3*b*, 3*c*, and 3*d* is decompressed by the utilization-side expansion valves 51*a*, 51*b*, 51*c*, and 51*d*, and is then sent to the utilization-side heat exchangers 52*a*, 52*b*, 52*c*, and 52*d*, respectively. The refrigerant sent to the utilization-side heat exchangers 52*a*, 52*b*, 52*c*, and 52*d* evaporates by being heated by exchanging heat with indoor air supplied from inside the room by the utilization-side fans 55*a*, 55*b*, 55*c*, and 55*d* in the utilization-side heat exchangers 52*a*, 52*b*, 52*c*, and 52*d* that function as refrigerant evaporators, respectively. The evaporated refrigerant flows out of the utilization-side units 3*a*, 3*b*, 3*c*, and 3*d*. Meanwhile, the indoor air cooled by the utilization-side heat exchangers 52*a*, 52*b*, 52*c*, and 52*d* is sent into the room, thereby cooling the room.

The refrigerant flowing out of the utilization-side units 3*a*, 3*b*, 3*c*, and 3*d* is sent to the relay units 4*a*, 4*b*, 4*c*, and 4*d* through the second branch pipe portions 6*aa*, 6*bb*, 6*cc*, and 6*dd* of the gas-refrigerant connection pipe 6, respectively. The refrigerant sent to the relay units 4*a*, 4*b*, 4*c*, and 4*d* flows out of the relay units 4*a*, 4*b*, 4*c*, and 4*d* through the gas-side cutoff valves 68*a*, 68*b*, 68*c*, and 68*d*, respectively.

The refrigerant flowing out of the relay units 4*a*, 4*b*, 4*c*, and 4*d* is sent to the heat source-side unit 2 in a combined state through the gas-refrigerant connection pipe 6 (the combined pipe portion and the first branch pipe portions 6*a*, 6*b*, 6*c*, and 6*d*). The refrigerant sent to the heat source-side unit 2 is sucked into the compressor 21 via the gas-side shutoff valve 28, the switching mechanism 22, and the accumulator 29.

(2-2) Heating Operation

During the heating operation in an exemplary case where all the utilization-side units 3*a*, 3*b*, 3*c*, and 3*d* perform the heating operation (an operation by each one of the utilization-side heat exchangers 52*a*, 52*b*, 52*c*, and 52*d* functioning as a refrigerant radiator and the heat source-side heat exchanger 23 functioning as a refrigerant evaporator), the switching mechanism 22 switches to the heating operation state (the state depicted by the broken line for the switching mechanism 22 in FIG. 2) to drive the compressor 21, the heat source-side fan 24, and the utilization-side fans 55*a*, 55*b*, 55*c*, and 55*d*. Furthermore, the liquid-side cutoff valves 71*a*, 71*b*, 71*c*, and 71*d* and the gas-side cutoff valves 68*a*, 68*b*, 68*c*, and 68*d* of the relay units 4*a*, 4*b*, 4*c*, and 4*d* are fully opened.

Here, various devices of the utilization-side units 3*a*, 3*b*, 3*c*, and 3*d* are operated by the utilization-side control units 93*a*, 93*b*, 93*c*, and 93*d*, respectively. The utilization-side control units 93*a*, 93*b*, 93*c*, and 93*d* transmit information indicating that the utilization-side units 3*a*, 3*b*, 3*c*, and 3*d* will perform the heating operation to the heat source-side control unit 92 and the relay-side control units 94*a*, 94*b*, 94*c*, and 94*d* via the transmission lines 95 and 96. Various devices of the heat source-side unit 2 and the relay units 4*a*, 4*b*, 4*c*, and 4*d* are operated by the heat source-side control unit 92 and the relay-side control units 94*a*, 94*b*, 94*c*, and 94*d* that receive the information from the utilization-side units 3*a*, 3*b*, 3*c*, and 3*d*, respectively.

The high-pressure refrigerant discharged from the compressor 21 flows out of the heat source-side unit 2 through the switching mechanism 22 and the gas-side shutoff valve 28.

The refrigerant flowing out of the heat source-side unit 2 is sent to the relay units 4*a*, 4*b*, 4*c*, and 4*d* via the gas-refrigerant connection pipe 6 (the combined pipe portion and the first branch pipe portions 6*a*, 6*b*, 6*c*, and 6*d*). The refrigerant sent to the relay units 4*a*, 4*b*, 4*c*, and 4*d* flows out of the relay units 4*a*, 4*b*, 4*c*, and 4*d* through the gas-side cutoff valves 68*a*, 68*b*, 68*c*, and 68*d*, respectively.

The refrigerant flowing out of the relay units 4*a*, 4*b*, 4*c*, and 4*d* is sent to the utilization-side units 3*a*, 3*b*, 3*c*, and 3*d* through the second branch pipe portions 6*aa*, 6*bb*, 6*cc*, and 6*dd* (portions of the gas-refrigerant connection pipe 6 that connects the relay units 4*a*, 4*b*, 4*c*, and 4*d* to the utilization-side units 3*a*, 3*b*, 3*c*, and 3*d*), respectively. The refrigerant sent to the utilization-side units 3*a*, 3*b*, 3*c*, and 3*d* is sent to the utilization-side heat exchangers 52*a*, 52*b*, 52*c*, and 52*d*, respectively. The high-pressure refrigerant sent to the utilization-side heat exchangers 52*a*, 52*b*, 52*c*, and 52*d* condenses by being cooled by exchanging heat with indoor air supplied from inside the room by the utilization-side fans 55*a*, 55*b*, 55*c*, and 55*d* in the utilization-side heat exchangers 52*a*, 52*b*, 52*c*, and 52*d* that function as refrigerant radiators, respectively. The condensed refrigerant is decompressed by the utilization-side expansion valves 51*a*, 51*b*, 51*c*, and 51*d*, and then flows out of the utilization-side units 3*a*, 3*b*, 3*c*, and 3*d*, respectively. Meanwhile, the indoor air heated by the utilization-side heat exchangers 52*a*, 52*b*, 52*c*, and 52*d* is sent into the room, thereby heating the room.

The refrigerant flowing out of the utilization-side units 3*a*, 3*b*, 3*c*, and 3*d* is sent to the relay units 4*a*, 4*b*, 4*c*, and 4*d* through the second branch pipe portions 5*aa*, 5*bb*, 5*cc*, and 5*dd* (portions of the liquid-refrigerant connection pipe 5 that connects the relay units 4*a*, 4*b*, 4*c*, and 4*d* to the utilization-side units 3*a*, 3*b*, 3*c*, and 3*d*), respectively. The refrigerant sent to the relay units 4*a*, 4*b*, 4*c*, and 4*d* flows out of the relay units 4*a*, 4*b*, 4*c*, and 4*d* through the liquid-side cutoff valves 71*a*, 71*b*, 71*c*, and 71*d*, respectively.

The refrigerant flowing out of the relay units 4*a*, 4*b*, 4*c*, and 4*d* is sent to the heat source-side unit 2 in a combined state through the liquid-refrigerant connection pipe 5 (the combined pipe portion and the first branch pipe portions 5*a*, 5*b*, 5*c*, and 5*d*). The refrigerant sent to the heat source-side unit 2 is sent to the heat source-side expansion valve 25 via the liquid-side shutoff valve 27 and the refrigerant cooler 45. The refrigerant sent to the heat source-side expansion valve 25 is decompressed by the heat source-side expansion valve 25 and is then sent to the heat source-side heat exchanger 23. The refrigerant sent to the heat source-side heat exchanger 23 exchanges heat with outdoor air supplied by the heat source-side fan 24 to be heated and thus evaporates. The refrigerant thus evaporated is sucked into the compressor 21 via the switching mechanism 22 and the accumulator 29.

(3) Operation of Air Conditioner Upon Refrigerant Leakage

Operation of the air conditioner 1 upon refrigerant leakage will be described next with reference to a control flow illustrated in FIG. 5. Similar to the basic operation described above, the following operation of the air conditioner 1 upon refrigerant leakage is performed by the control unit 19 configured to control the constituent devices of the air conditioner 1 (the heat source-side unit 2, the utilization-side units 3*a*, 3*b*, 3*c*, and 3*d*, and the relay units 4*a*, 4*b*, 4*c*, and 4*d*).

Similar control is performed regardless of which one of the utilization-side units 3*a*, 3*b*, 3*c*, and 3*d* has refrigerant leakage. Described herein is an exemplary case of detection of refrigerant leakage into the room equipped with the utilization-side unit 3*a*.

Figure 5:
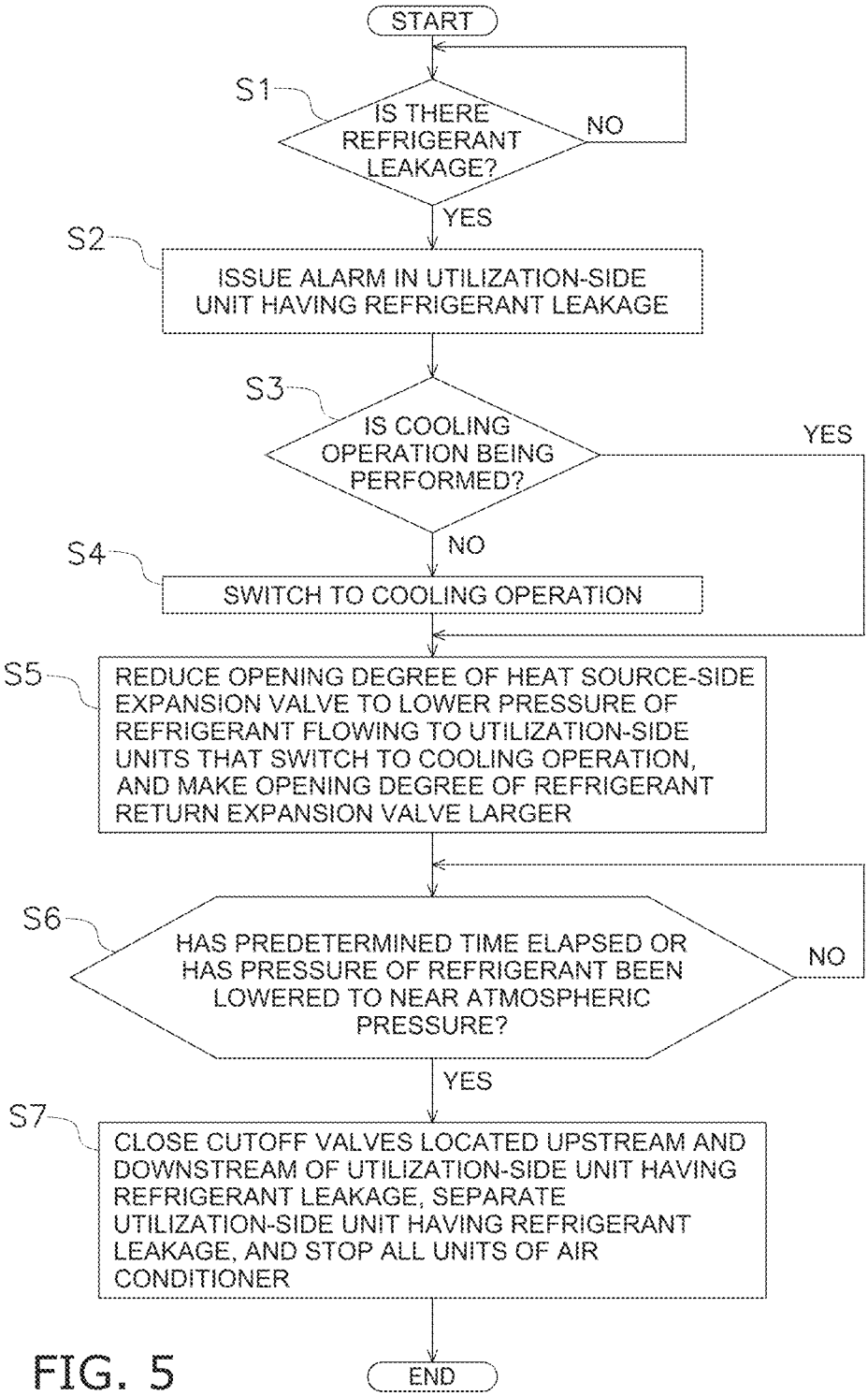
FIG. 5 is a chart illustrating a control flow against refrigerant leakage.

In Step S1 in FIG. 5, the control unit 19 determines which one of the refrigerant leakage detection units 79*a*, 79*b*, 79*c*, and 79*d* of the utilization-side units 3*a*, 3*b*, 3*c*, and 3*d* detects refrigerant leakage. In a case where the refrigerant leakage detection unit 79*a* of the utilization-side unit 3*a* detects refrigerant leakage into the predetermined space (room) equipped with the utilization-side unit 3*a*, the flow transitions to subsequent Step S2.

In Step S2, in the utilization-side unit 3*a* having refrigerant leakage, the control unit 19 issues an alarm to a person in the predetermined space of the utilization-side unit 3*a* by using an alarm device (not illustrated) that issues an alarm with an alarm sound such as a buzzer and turns on a light.

Next, in Step S3, the control unit 19 determines whether or not the utilization-side unit 3*a* is performing the cooling operation. Here, when the utilization-side unit 3*a* is performing the heating operation, or when the utilization-side unit 3*a* is in a stopped or suspended state in which neither cooling nor heating is performed, the flow transitions from Step S3 to Step S4.

In Step S4, the utilization-side unit 3*a* performs the cooling operation in order to lower the pressure of the refrigerant of the utilization-side unit 3*a*. However, unlike the normal cooling operation, the cooling operation in Step S4 is an operation of giving priority to lowering the pressure of the refrigerant of the utilization-side unit 3*a*. When the air conditioner 1 performs the heating operation, the switching mechanism 22 switches to the cooling operation state to cause the air conditioner 1 to perform the cooling operation. When the utilization-side unit 3*a* is in a stopped or suspended state, the utilization-side unit 3*a* is put into the cooling operation state to lower the pressure of the refrigerant of the utilization-side unit 3*a*.

Following Step S4, in Step S5, the control unit 19 reduces the opening degree of the heat source-side expansion valve 25 of the heat source-side unit 2. In the normal cooling operation, the heat source-side expansion valve 25 is fully opened, but here, the opening degree of the heat source-side expansion valve 25 is reduced to lower the pressure of the refrigerant flowing to the utilization-side units 3*a*, 3*b*, 3*c*, and 3*d*. Note that the utilization-side expansion valve 51*a* of the utilization-side unit 3*a* is in a fully open state.

In Step S5, the control unit 19 makes the opening degree of the refrigerant return expansion valve 44 larger than in the normal cooling operation to increase the amount of refrigerant flowing through the refrigerant return pipe 41 that functions as a bypass route. With this operation, out of the refrigerant that radiates heat and condenses in the heat source-side heat exchanger 23 and heads for the utilization-side units 3*a*, 3*b*, 3*c*, and 3*d*, more refrigerant returns to the suction side of the compressor 21 through the refrigerant return pipe 41. In other words, a smaller portion of the refrigerant radiates heat to be condensed in the heat source-side heat exchanger 23, and flows to the utilization-side units 3*a*, 3*b*, 3*c*, and 3*d*. This control leads to quicker decrease in pressure of the refrigerant of the utilization-side unit 3*a* having refrigerant leakage. The refrigerant having flown through the refrigerant return pipe 41 flows into the accumulator 29. Part of the refrigerant thus having flown thereinto can thus be accumulated in the accumulator 29.

Moreover, in Step S5, the number of revolutions of the utilization-side fan 55*a* can be decreased.

In Step S6, the control unit 19 determines whether or not the pressure of the refrigerant of the utilization-side unit 3*a* has been lowered sufficiently based on sensor values of the utilization-side heat exchange liquid-side sensor 57*a* and the utilization-side heat exchange gas-side sensor 58*a* of the utilization-side unit 3*a*. When the control unit 19 determines that the sensor values satisfy predetermined conditions and the pressure of the refrigerant of the utilization-side unit 3*a* has been sufficiently lowered, the flow transitions from Step S6 to Step S7. In Step S6, the passage of time is also monitored, and if a predetermined time has elapsed after performing Step S5, the control unit 19 determines that the pressure of the refrigerant of the utilization-side unit 3*a* has been lowered to some extent, and the flow transitions to Step S7.

Note that in Step S6, the control unit 19 monitors the pressure of the refrigerant of the utilization-side unit 3*a*, and substantially controls the pressure of the refrigerant in the utilization-side unit 3*a* from becoming lower than the atmospheric pressure. The flow transitions from Step S6 to Step S7 before the pressure of the refrigerant in the utilization-side unit 3*a* becomes lower than the atmospheric pressure.

In Step S7, the control unit 19 closes the liquid-side cutoff valve 71*a* and the gas-side cutoff valve 68*a* of the relay unit 4*a* corresponding to the utilization-side unit 3*a* having refrigerant leakage. The utilization-side unit 3*a* is thus separated from the refrigerant circuit 10 having refrigerant circulation, to substantially stop the flow of the refrigerant from the heat source-side unit 2 to the utilization-side unit 3*a*. The, in Step S7, the control unit 19 stops all the units including the remaining utilization-side units 3*b*, 3*c*, and 3*d* and the heat source-side unit 2.

(4) Designing or Selection of Gas-Side Cutoff Valve and Liquid-Side Cutoff Valve As described above, the liquid-side cutoff valves 71*a*, 71*b*, 71*c*, and 71*d* and the gas-side cutoff valves 68*a*, 68*b*, 68*c*, and 68*d* are controlled to be closed upon detection of refrigerant leakage (see Step S7 in FIG. 4). In other words, if refrigerant leakage is detected in any one of the utilization-side units 3*a*, 3*b*, 3*c*, and 3*d*, the liquid-side cutoff valve 71*a*, 71*b*, 71*c*, or 71*d* and the gas-side cutoff valve 68*a*, 68*b*, 68*c*, or 68*d* of the corresponding relay unit 4*a*, 4*b*, 4*c*, or 4*d* are switched from a non-cutoff state into the cutoff state where the cutoff valves are closed.

In the air conditioner 1 according to one or more embodiments, the liquid-side cutoff valve 71*a*, 71*b*, 71*c*, or 71*d* and the gas-side cutoff valve 68*a*, 68*b*, 68*c*, or 68*d* are designed or selected in the following manner.

(4-1) Regarding Room (Predetermined Space) Equipped with Utilization-Side Unit of Air Conditioner Information on an architecture equipped with the air conditioner 1, specifically, information on the room equipped with the utilization-side units 3*a*, 3*b*, 3*c*, and 3*d* is acquired before selection or designing of the gas-side cutoff valve and the liquid-side cutoff valve.

Figure 3:
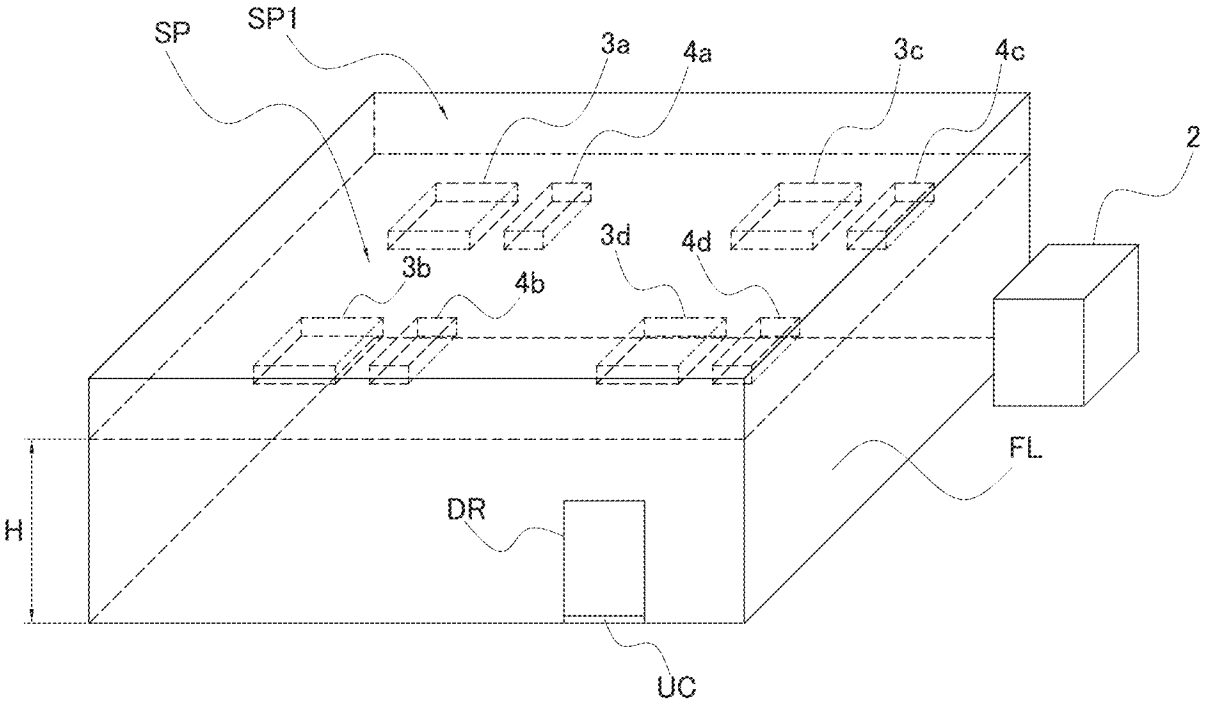
FIG. 3 is a diagram illustrating a room (predetermined space) in which the air conditioner is disposed.

In this case, four utilization-side units 3*a*, 3*b*, 3*c*, and 3*d* as well as the relay units 4*a*, 4*b*, 4*c*, and 4*d* are disposed in the space SP1 behind the ceiling of the room (predetermined space) SP illustrated in FIG. 3. The room SP has a floor FL not equipped with any utilization-side unit. In other words, the utilization-side units 3*a*, 3*b*, 3*c*, and 3*d* are to be installed at a ceiling and are not to be placed on a floor.

The room SP is provided with a door DR allowing a person to enter or leave the room. The door DR is closed when no person enters or leaves the room. The door DR is provided therebelow with a clearance (undercut portion) UC. The ceiling of the room SP is provided with a ventilating hole (not illustrated). The clearance UC has an area of $A_d$ ($m^2$). In an exemplary case where the clearance UC is 4 mm in height and is 800 mm in width, the area $A_d$ of the clearance UC is 0.0032 ($m^2$) obtained by multiplying these values.

The utilization-side units 3*a*, 3*b*, 3*c*, and 3*d* are disposed in the space SP1 behind the ceiling of the room SP, so that a distance H from the floor FL to each of the utilization circuits 3*aa*, 3*bb*, 3*cc*, and 3*dd* of the utilization-side units 3*a*, 3*b*, 3*c*, and 3*d* is assumed to be equal to the height (the height of the ceiling) of the room SP.

(4-2) Method of Calculating Refrigerant Leakage Velocities at Gas-Side Cutoff Valve and Liquid-Side Cutoff Valve Described next in order is a method of calculating a cutoff leakage rate, which is required for designing or selection of the gas-side cutoff valve and the liquid-side cutoff valve. The following description refers generally to a gas-side cutoff valve and a liquid-side cutoff valve, and a utilization unit without specifying any of the gas-side cutoff valves and the liquid-side cutoff valves, and the utilization units uniquely included in the air conditioner 1 according to one or more embodiments. The gas-side cutoff valve and the liquid-side cutoff valve, and the utilization unit will thus be described without using any reference numerals and signs in the drawings.

In addition, in one or more embodiments, the cutoff leakage rate is evaluated using "air" as gas that is in a single gas phase in a standard state.

Figure 6:
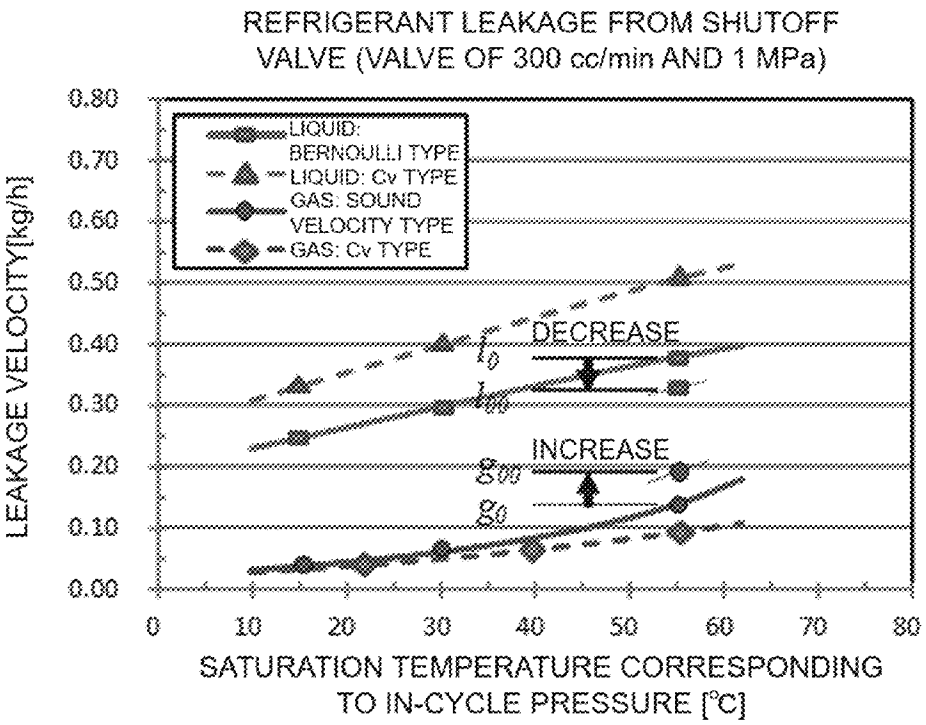
FIG. 6 is a diagram illustrating refrigerant leakage velocities at a gas-side cutoff valve and a liquid-side cutoff valve when the gas-side cutoff valve and the liquid-side cutoff valve are valves that satisfy "Annex A (Prescription) Specifications of safety cutoff valves" in the guideline of The Japan Refrigeration and Air Conditioning Industry Association.

As described above, in the "Annex A (Prescription) Specifications of safety cutoff valves" in the guideline by The Japan Refrigeration and Air Conditioning Industry Association, when fluid is air and a differential pressure between upstream and downstream of each of the gas-side cutoff valve and the liquid-side cutoff valve is 1 MPa, 300 ($cm^3$/min) or less is prescribed as the cutoff leakage rate to be satisfied by the gas-side cutoff valve and the liquid-side cutoff valve. It is possible to calculate a valve clearance when the gas-side cutoff valve and the liquid-side cutoff valve are closed, and the refrigerant leakage velocities at the gas-side cutoff valve and the liquid-side cutoff valve, which are assumed by the above guideline, from the same cutoff leakage rate uniformly requested to the gas-side cutoff valve and the liquid-side cutoff valve. As illustrated in FIG. 6, in the same leakage clearance, the refrigerant leakage velocity at the liquid-side cutoff valve is higher than the refrigerant leakage velocity at the gas-side cutoff valve. This is because the liquid refrigerant has a higher density than the gas refrigerant. Therefore, if the refrigerant leakage velocity can be calculated from the above guideline, it is possible to calculate how much the cutoff leakage rate of the gas-side cutoff valve can be increased within a range not exceeding the refrigerant leakage velocity.

The refrigerant leakage velocities at the gas-side cutoff valve and the liquid-side cutoff valve when the gas-side cutoff valve and the liquid-side cutoff valve satisfy the specifications of the above guideline are as illustrated in FIG. 6.

A horizontal axis in FIG. 6 represents a saturation temperature corresponding to an in-cycle pressure of the refrigerant. When an ambient temperature of the room (predetermined space) where the liquid refrigerant is accumulated or the heat source-side heat exchanger is changed, the saturation temperature corresponding to the in-cycle pressure is changed. Here, first, the refrigerant leakage velocity derived from the cutoff leakage rate in the above guideline may be calculated by using a method of calculating the refrigerant leakage rate of the liquid refrigerant by a formula using Bernoulli's theorem and calculating the refrigerant leakage rate of the gas refrigerant by a formula expressing a flow rate of compressible fluid (first calculation method). Second, a method of calculating the refrigerant leakage rate by using a Cv value representing a leakage rate unique to each of the gas-side cutoff valve and the liquid-side cutoff valve (second calculation method) may be used. The refrigerant leakage velocity can also be calculated from the calculation of the leakage rate described above. In FIG. 6, a value according to the first calculation method is represented by a solid line, and a value according to the second calculation method is represented by a broken line. Here, R32, which is a combustibility rank A2L, was taken as a representative of the flammable refrigerant. Similar to R32, the same drawing can apply to other flammable refrigerants by setting a physical property value to a value of each refrigerant.

(4-2-1) Calculation of Valve Clearance Equivalent Diameter $d_v$ when Gas-Side Cutoff Valve and Liquid-Side Cutoff Valve are Closed In the above guideline, when fluid is air and a differential pressure (predetermined differential pressure) between upstream and downstream of each of the gas-side cutoff valve and the liquid-side cutoff valve is 1 MPa, 300 ($cm^3$/min) or less is prescribed as the cutoff leakage rate to be satisfied by the gas-side cutoff valve and the liquid-side cutoff valve. From these conditions, first, the valve clearances when the gas-side cutoff valve and the liquid-side cutoff valve are closed are obtained.

A valve clearance sectional area $A_v$ is obtained from an air volume flow rate, an air inlet absolute pressure, an air density, and an air specific heat ratio, and the valve clearance equivalent diameter $d_v$ is then obtained, assuming that the section has a circular shape. Air is assumed to have a specific heat ratio κ (20° C.) of 1.40. When a pressure ratio P2/P1 exceeds $(2/(\kappa+1))\times(\kappa/(\kappa-1))$, a flow velocity exceeds a sound velocity. At the above differential pressure, P2/P1=(1+0.1013)/0.1013=10.87, and $(2/(\kappa+1))\times(\kappa/(\kappa-1))=(2/2.4)\times1.4/0.4=0.528$, and the flow velocity thus exceeds a supersonic velocity.

A mass flow rate $G_a$, a volume flow rate $Q_a$, and the valve clearance equivalent diameter $d_v$ are obtained in accordance with the following formulae. In a case where the flow velocity exceeds the sound velocity, $$G_a=A_v\times(2/(\kappa+1))^{((\kappa+1)/2(\kappa-1))}\times(\kappa\times P_{1a}\times\rho_{1a})^{0.5}, \quad \text{(Formula 1):}$$

$$A_v=Q_a\times\rho_{2a}\times(2/(\kappa+1))^{(-(\kappa+1)/2(\kappa-1))}\times(\kappa\times P_{1a}\times\rho_{1a})^{(-0.5)}, \quad \text{(Formula 2):}$$

and $$d_v=(4\times A_v/\pi)^{0.5}, \quad \text{(Formula 3):}$$

In the above guideline, it is defined that the cutoff leakage rates to be satisfied by the gas-side cutoff valve and the liquid-side cutoff valve are 300 ($cm^3$/min) or less, which corresponds to $5\times10^{-6}$ ($m^3$/s). In the above guideline, the same cutoff leakage rate of 300 ($cm^3$/min) or less is set for both the gas-side cutoff valve and the liquid-side cutoff valve. Therefore, the same valve clearance is assumed for both the gas-side cutoff valve and the liquid-side cutoff valve.

This condition is substituted in (Formula 2) to obtain $A_v$. The above "Annex A (Prescription) Specifications of safety cutoff valves" tolerates a valve clearance ($d_{vG}$) and a valve clearance sectional area ($A_{vG}$) obtained by the following formulae:

$$d_{vG}=d_{vL}=5.47E-5\ (m),\ \text{and}$$

$$A_{vG}=A_{vL}=2.24E-9\ (m^2).$$

(4-2-2) Calculation of Refrigerant Leakage Velocity According to First Calculation Method Calculated next is a leakage velocity $G_r$ of a refrigerant leaking from the obtained valve clearance ($d_{vG}$).

This calculation is made assuming that a refrigerant in a liquid phase is located upstream of the cutoff valve viewed from the utilization-side unit in a liquid-side line (liquid-refrigerant connection pipe) and that a refrigerant in a gas phase is located upstream of the cutoff valve viewed from the utilization-side unit in a gas-side line (gas-refrigerant connection Pipe).

A refrigerant leakage velocity on the liquid-side line, that is, the refrigerant leakage velocity ($G_{rL}$) at the liquid-side cutoff valve is initially obtained in accordance with the Bernoulli's theorem assuming that a leakage hole serves as an orifice and a refrigerant in a liquid phase passes the leakage hole, by $$G_{rL}=C_r\times(2\times\Delta P_r/\rho_{1rl})^{0.5}\times A_{vL}\times\rho_{1rl}. \quad \text{(Formula 4):}$$

Next, the refrigerant leakage velocity on the gas-side line, that is, the refrigerant leakage velocity ($G_{rG}$) at the gas-side cutoff valve exceeds the sound velocity. The specific heat ratio κ is assumed to have a representative value equal to a value of saturated gas of the refrigerant at 20° C. The refrigerant leakage velocity ($G_{rG}$) on the gas-side line is obtained by $$G_{rG}=A_{vG}\times(2/(\lambda+1))^{(\lambda+1)/2(\lambda-1))}\times(\lambda\times P_{1r}\times\rho_{1rg})^{0.5}. \quad \text{(Formula 5):}$$

When both the liquid-side cutoff valve and the gas-side cutoff valve are closed, the leakage velocity $G_r$ of the refrigerant flowing into the predetermined space is obtained by $$G_r=G_{rL}+G_{rG}=C_r\times(2\times\Delta P_r/\rho_{1rl})^{0.5}\times A_{vL}\times\rho_{1rl}+A_{vG}\times(2/(\lambda+1))^{((\lambda+1)/2(\lambda-1))}\times(\lambda\times P_{1r}\times\rho_{1rg})^{0.5}. \quad \text{(Formula 6):}$$

Examples of variables influencing the leakage velocity of refrigerant through the valve clearance of the cutoff valve include (4-2-2-A) to (4-2-2-E). The variables are calculated in the following manners.

(4-2-2-A) Refrigerant Type

The refrigerant is assumed to be selected from R32, R452B, R454B, R1234yf, and R1234ze(E), and each of the refrigerants has a physical property value calculated in accordance with NIST Refprop V9.1.

(4-2-2-B) Ambient Temperature Determining Refrigerant Pressure Upstream of Cutoff Valve After Air Conditioner Stops, and Differential Pressure Between Refrigerant Pressure and Atmospheric Pressure After the air conditioner stops, a pressure of the refrigerant closer to the heat source-side unit (upstream) than to the cutoff valve can be assumed to be determined by a maximum temperature outside an architecture. In accordance with high temperature test conditions for air conditioners in the U.S. (Table 1 below), the maximum outside temperature is set to 55° C. and a refrigerant pressure upstream of the cutoff valve is set to a saturation pressure at 55° C.

TABLE 1

| | Outdoor[a] | Indoor | | | |
|---|---|---|---|---|---|
| Test condition | Dry-bulb temperature ° C. (° F.) | Dry-bulb temperature ° C. (° F.) | Wet-bulb temperature ° C. (° F.) | Dew point temperature[b] ° C. (° F.) | Relative humidity[b] % |
| AHRI B[C] | 27.8 (82) | 26.7 (80.0) | 19.4 (67) | 15.8 (60.4) | 50.9 |
| AHRI a[C] | 35.0 (95) | 26.7 (80.0) | 19.4 (67) | 15.8 (60.4) | 50.9 |
| T3*[d] | 46 (114.8) | 26.7 (80.0) | 19 (66.2) | 15.8 (60.4) | 50.9 |
| T3 | 46 (114.8) | 29 (84.2) | 19 (66.2) | 13.7 (56.6) | 39 |
| Hot | 52 (125.6) | 29 (84.2) | 19 (66.2) | 13.7 (56.6) | 39 |
| Extreme | 55 (131) | 29 (84.2) | 19 (66.2) | 13.7 (56.6) | 39 |

[a]There is no specification for the outdoor relative humidity as it has no impact on the performance.
[b]Dew-point temperature and relative humidity evaluated at 0.973 atm (14.3 psi)
[C]Per AHRI Standard 210/240
[d]T3* is a modified T3 condition in which the indoor settings are similar to the AHRI conditions.

Source:

Alternative Refrigerant Evaluation for High-Ambient-Temperature Environments: R-22 and R-410A Alternatives for Mini-Split Air Conditioners, ORNL, P5, 2015

(4-2-2-C) Liquid Density and Gas Density

A density (kg/$m^3$) of a liquid-phase refrigerant and a density (kg/$m^3$) of a gas-phase refrigerant are calculated in accordance with NIST Refprop V9.1.

(4-2-2-D) Specific Heat Ratio

The specific heat ratio is calculated in accordance with NIST Refprop V9.1. Adopted is a specific heat ratio of saturated gas of the refrigerant at 27° C.

(4-2-2-E) Refrigerant States on Liquid-Side Line and Gas-Side Line

Assumed after the cutoff valve is brought into the cutoff state are whether the refrigerant on the liquid-side line and the refrigerant on the gas-side line upstream of the cutoff valve are in the liquid phase and in the gas phase or are in the gas phase and in the gas phase, respectively. Calculation is made assuming the former case where a calculated refrigerant leakage velocity is higher. In other words, calculation is made after the cutoff valve is brought into the cutoff state, assuming that the refrigerant on the liquid-side line upstream of the cutoff valve is in the liquid phase and the refrigerant on the gas-side line upstream of the cutoff valve is in the gas phase.

When the variables are calculated as described above, the leakage velocity of each refrigerant leaking from the valve clearance is indicated in Table 2 below.

TABLE 2

Leakage Velocity of Refrigerant through Valve Clearance When Cutoff Valve is Closed

| Refrigerant | Refrigerant pressure $P_{1r}$ [Mpa] | Liquid density $\rho_{1rl}$ [kg/m3] | Gas density $\rho_{1rg}$ [kg/m3] | Specific heat ratio $\lambda$ [−] | Liquid-side leakage velocity $G_{rL}$ [kg/h] | Gas-side leakage velocity $G_{rG}$ [kg/h] | Sum of leakage velocities $G_r$ [kg/h] |
|---|---|---|---|---|---|---|---|
| R32 | 3.52 | 808 | 115.0 | 1.71 | 0.377 | 0.125 | 0.502 |
| R1234yf | 1.46 | 967 | 87.0 | 1.21 | 0.261 | 0.062 | 0.323 |
| R1234(E) | 1.13 | 1054 | 61.3 | 1.17 | 0.236 | 0.045 | 0.282 |
| R452B | 3.08 | 854 | 106.0 | 1.88 | 0.362 | 0.115 | 0.477 |
| R454B | 3.00 | 853 | 99.4 | 1.87 | 0.357 | 0.110 | 0.467 |

Condition) The ambient temperature is 55 [° C.], the cutoff valve clearance corresponds to 300 [cc/min], and the specific heat ratio is 27 [° C.].

Refrigerant leakage velocities at varied ambient temperatures (temperatures outside an architecture) can be obtained in accordance with (Formula 4), (Formula 5), and (Formula 6) by varying the physical property values. The refrigerant leakage velocity tends to be higher as the ambient temperature is higher. Cutoff valves adapted to various regions can thus be selected or designed by obtaining the refrigerant leakage velocities in accordance with conditions of outside temperatures (maximum outside temperatures) in the various regions.

(4-2-3) Calculation of Refrigerant Leakage Velocity According to Second Calculation Method Formulae when the leakage rates at the gas-side cutoff valve and the liquid-side cutoff valve are calculated using the Cv value representing the leakage rate unique to each valve is as follows.

When the leakage rate at the gas-side cutoff valve is obtained using the Cv value, $$Cv=Q\times 3600\times(\rho/\rho_a\times(273+20))^{0.5}/(2519\times P1/1000000). \quad \text{(Formula 7):}$$

When the leakage rate at the liquid-side cutoff valve is obtained using the Cv value, $$Cv=0.02194\times Q\times 1000\times 60\times(\rho/1000/\Delta p/1000000)^{0.5}. \quad \text{(Formula 8):}$$

In the above guideline, the leakage rates at the gas-side cutoff valve and the liquid-side cutoff valve are 300 ($cm^3$/min) or less when the fluid is air and the differential pressure between upstream and downstream of each of the gas-side cutoff valve and the liquid-side cutoff valve is 1 MPa. Therefore, when using (Formula 7), $Cv=1.11\times 10^{-4}$.

The leakage velocities of the gas refrigerant and the liquid refrigerant can be calculated by using the Cv value in accordance with (Formula 7) and (Formula 8).

(4-3)

The refrigerant leakage velocities through the valve clearances assumed in the above guideline can be obtained by the calculation made in (4-1) to (4-2). Next, how much the cutoff leakage rate at the gas-side cutoff valve can be increased is calculated on the basis of the refrigerant leakage velocities. In addition, how much the cutoff leakage rate at the liquid-side cutoff valve is appropriately reduced with the increase in the cutoff leakage rate at the gas-side cutoff valve is calculated. Therefore, the cutoff leakage rate at each of the gas-side cutoff valve and the liquid-side cutoff valve is changed from 300 ($cm^3$/min) and designed or selected so that the sum of the refrigerant leakage velocities at the gas-side cutoff valve and the liquid-side cutoff valve is equivalent to the sum of the refrigerant leakage velocities in a case where the same valve clearance is assumed for both the gas-side cutoff valve and the liquid-side cutoff valve according to the above guideline.

In this case, the change in the refrigerant leakage velocities at the gas-side cutoff valve and the liquid-side cutoff valve is as illustrated in FIG. 6.

When the cutoff leakage rates at the gas-side cutoff valve and the liquid-side cutoff valve are changed, the refrigerant leakage velocity at the gas-side cutoff valve increases from $g_0$ to $g_{00}$, and the refrigerant leakage velocity at the liquid-side cutoff valve decreases from $l_0$ to $l_{00}$. Here, a ratio of the refrigerant leakage velocity at the liquid-side cutoff valve to the refrigerant leakage velocity at the gas-side cutoff valve before changing the cutoff leakage rates at the gas-side cutoff valve and the liquid-side cutoff valve is as follows:

$$l_0/g_0=X. \quad \text{(Formula 9):}$$

A ratio of the refrigerant leakage velocity at the gas-side cutoff valve after changing the cutoff leakage rate to the refrigerant leakage velocity at the gas-side cutoff valve before changing the cutoff leakage rate is calculated as follows:

$$g_{00}/g_0=Y. \quad \text{(Formula 10):}$$

In a case where it is assumed that the sum of the refrigerant leakage velocities at the liquid-side cutoff valve and the gas-side cutoff valve does not change before and after changing the cutoff leakage rates, $$l_0-l_{00}=g_{00}-g_0. \quad \text{(Formula 11):}$$

When (Formula 11) is deformed using (Formula 9) and (Formula 10), $$l_{00}=(X-Y+1)\times g_0. \quad \text{(Formula 12):}$$

Therefore, the change in the refrigerant leakage velocity at the liquid-side cutoff valve can be obtained by the following formula:

$$l_{00}/l_0=1-(Y-1)/X. \quad \text{(Formula 13):}$$

Table 3 shows a pipe diameter of the gas-refrigerant connection pipe diameter and a pipe diameter of the liquid-refrigerant connection pipe.

TABLE 3

| Capability [*100 W] | Outer diameter of liquid pipe [mm] | Outer diameter of gas pipe [mm] | Ratio between pipe diameters of gas pipe and liquid pipe |
|---|---|---|---|
| 40 | 6.4 | 12.7 | 1.98 |
| 45 | 6.4 | 12.7 | 1.98 |
| 50 | 6.4 | 12.7 | 1.98 |
| 56 | 6.4 | 12.7 | 1.98 |

TABLE 3-continued

| Capability [*100 W] | Outer diameter of liquid pipe [mm] | Outer diameter of gas pipe [mm] | Ratio between pipe diameters of gas pipe and liquid pipe |
|---|---|---|---|
| 63 | 6.4 | 12.7 | 1.98 |
| 80 | 9.5 | 15.9 | 1.67 |
| 112 | 9.5 | 15.9 | 1.67 |
| 140 | 9.5 | 15.9 | 1.67 |
| 160 | 9.5 | 15.9 | 1.67 |
| 224 | 9.5 | 25.4 | 2.67 |
| 280 | 12.7 | 25.4 | 2.00 |

Figure 7:
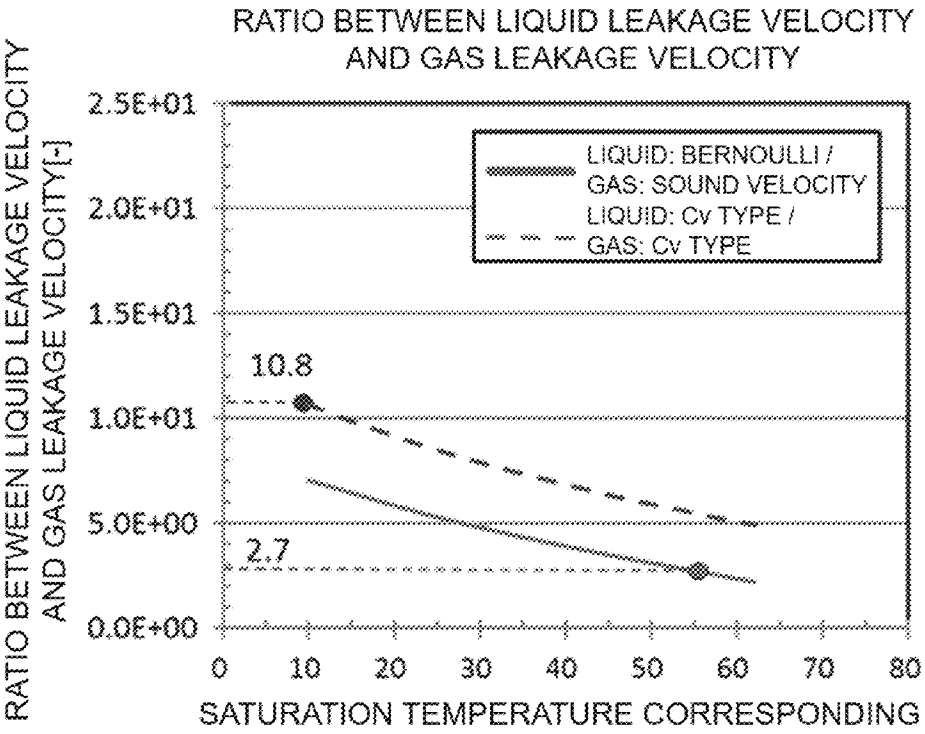
FIG. 7 is a diagram illustrating a ratio of the refrigerant leakage velocity at the liquid-side cutoff valve to the refrigerant leakage velocity at the gas-side cutoff valve.

As shown in the item of gas/liquid-side pipe diameter in Table 3, a ratio between the pipe diameter of the gas-side refrigerant connection pipe to the pipe diameter of the liquid-side refrigerant connection pipe is in a range of about 1.6 times to about 2.7 times. The cutoff leakage rate at the gas-side cutoff valve with respect to the cutoff leakage rate at the liquid-side cutoff valve increases in proportion to the ratio between the pipe diameters of the refrigerant connection pipes. FIG. 7 illustrates X that is a ratio of the refrigerant leakage velocity at the liquid-side cutoff valve to the refrigerant leakage velocity at the gas-side cutoff valve. When a pressure in a refrigerant cycle is changed in a range from a saturation pressure at 10° C. to a saturation pressure at 55° C., X is changed in a range of 2.7 times to 10.8 times.

Here, when Y=1.6, $l_{00}/l_0=1-0.6/X$ in accordance with Formula (13), and at this time, when X is changed in a range of 2.7 times to 10.8 times, $l_{00}/l_0$ indicating the change in the refrigerant leakage velocity at the liquid-side cutoff valve is changed in a range of 0.78 times to 0.94 times. Therefore, in this case, a maximum cutoff leakage rate at the liquid-side cutoff valve may be designed or selected in a range of 0.78 times to 0.94 times of 300 ($cm^3$/min).

Similarly, when Y=2.7, $l_{00}/l_0=1-1.7/X$ in accordance with the Formula (13), and at this time, when X is changed in a range of 2.7 times to 10.8 times, $l_{00}/l_0$ indicating the change in the refrigerant leakage velocity an the liquid-side cutoff valve is changed in a range of 0.37 times to 0.84 times. Therefore, in this case, the maximum cutoff leakage rate at the liquid-side cutoff valve may be designed or selected in a range of 0.37 times to 0.84 times of 300 ($cm^3$/min).

These results show that when the refrigerant leakage velocity at the gas-side cutoff valve is changed in a range of 1.6 times to 2.7 times, $l_{00}/l_0$, which is the change in the refrigerant leakage velocity at the liquid-side cutoff valve, is changed in a range of 0.37 times to 0.94 times.

As described above, the cutoff leakage rate at the gas-side cutoff valve can be increased in a range of 1.0 times to 2.7 times or less of 300 ($cm^3$/min) which is the cutoff leakage rate prescribed in the above guideline. In this case, the cutoff leakage rate at the liquid-side cutoff valve is set within a range of 0.94 times or less of 300 ($cm^3$/min) which is the cutoff leakage rate prescribed in the above guideline.

As long as the cutoff leakage rates at the gas-side cutoff valve and the liquid-side cutoff valve are changed within this range, the sum of the refrigerant leakage velocities at the gas-side cutoff valve and the liquid-side cutoff valve is equivalent to the sum of the refrigerant leakage velocities in a case where the same valve clearance is assumed for both the gas-side cutoff valve and the liquid-side cutoff valve according to the above guideline.

In a case where the design or selection is made more appropriately, when the cutoff leakage rate at the gas-side cutoff valve is changed in a range of 1.6 times to 2.7 times of 300 ($cm^3$/min) which is the cutoff leakage rate prescribed in the above guideline, the cutoff leakage rate at the liquid-side cutoff valve is changed in a range of 0.37 times to 0.94 times of 300 ($cm^3$/min) which is the cutoff leakage rate prescribed in the above guideline.

(4-4)

Next, it is assumed that a door is installed in a predetermined space (room) in which the utilization-side unit of the air conditioner is installed. There is a clearance below the door, and it is considered that the leaking refrigerant is discharged to the outside of the room through the clearance below the door. Based on the above, the refrigerant leakage velocity at the cutoff valve is set.

First, a refrigerant discharge velocity $G_d$ of the refrigerant discharged to the outside of the room through the clearance below the door is calculated.

$$G_d=\rho_{md}\times V_{md}\times A_d \quad \text{(Formula 14):}$$

$$V_{md}=C_d\times(2\times\Delta p_d/\rho_{md})^{0.5} \quad \text{(Formula 15):}$$

$$\Delta p_d=(\rho_{md}-\rho_a)\times g\times h_s \quad \text{(Formula 16):}$$

$$\rho_{md}=\rho_{mr}+\rho_{ma} \quad \text{(Formula 17):}$$

$$\rho_{mr}=N/100\times(U_r\times10^{-3})/(24.5\times10^{-3}) \quad \text{(Formula 18):}$$

$$\rho_{ma}=(100-N)/100\times(U_a\times10^{-3})/(24.5\times10^{-3}) \quad \text{(Formula 19):}$$

$$N=LFL/S \quad \text{(Formula 20):}$$

Examples of variables influencing the refrigerant discharge velocity include (4-4-1-A) and (4-4-1-B).

(4-4-1-A) Leakage Height (4-4-1-B) Safety Coefficient for Lower Flammability Limit (LFL) of Average Refrigerant Concentration in Room (Predetermined Space)

A leakage height is a position of the first portion in the predetermined space when the refrigerant leaks into the predetermined space. The leakage height is 2.2 m or the like when the utilization-side unit is installed at the ceiling and is 0.6 m or the like when the utilization-side unit is placed on the floor (see IEC60335-2-40: 2016). A tolerable average concentration is an average concentration of the refrigerant leaking into the predetermined space, and is a refrigerant concentration in a range where it is recognized that there is no risk of combustion of the refrigerant leaking into the predetermined space. The tolerable average concentration is obtained by dividing a LFL by a safety coefficient. The refrigerant discharge velocity is influenced by the safety coefficient set to 4 or 2, as exemplarily indicated by Table 4 below.

TABLE 4

Refrigerant discharge velocity Gd [kg/h] of refrigerant discharged to outside of room through clearance below door

| Tolerable average concentration | | ¼LFL | ¼LFL | ½LFL | ½LFL |
|---|---|---|---|---|---|
| Leakage height | | 2.2 m | 0.6 m | 2.2 m | 0.6 m |
| Refrigerant | R32 | 0.983 | 0.513 | 2.714 | 1.417 |
| | R1234yf | 1.152 | 0.594 | 3.149 | 1.645 |
| | R1234ze(E) | 1.220 | 0.637 | 3.374 | 1.762 |
| | R452B | 1.092 | 0.570 | 3.036 | 1.586 |
| | R454B | 1.063 | 0.555 | 2.957 | 1.544 |

(4-4-2)

Calculated next is a maximum cutoff leakage rate ($Q_{max}$) of the cutoff valve in the cutoff state in a case where the door is provided therebelow with the clearance.

When the refrigerant discharge velocity $G_d$ of the refrigerant discharged to the outside of the room (predetermined space) through the clearance below the door is higher than the refrigerant leakage velocity $G_r$ through the valve clearance when the cutoff valve is in the cutoff state, the cutoff leakage rate can be made higher than 300 ($cm^3$/min). As mentioned above in (4-2-1), if the gas-side cutoff valve and the liquid-side cutoff valve are set to have the identical maximum tolerable cutoff leakage rate ($Q_{max}$), a multiplying factor R for 300 ($cm^3$/min) specified in the guideline of The Japan Refrigeration and Air Conditioning Industry Association is identical for the gas-side cutoff valve and the liquid-side cutoff valve.

$$R=G_d/G_r \quad \text{(Formula 21):}$$

$$Q_{max}=300\times R \quad \text{(Formula 22):}$$

Assume herein that, before the cutoff valves are brought into the cutoff state, a refrigerant in a liquid phase is provided upstream of the cutoff valve on the liquid-side line, and a refrigerant in a gas phase is provided upstream of the cutoff valve on the gas-side line. (Formula 23) is obtained by substituting (Formula 6) and (Formula 15) in (Formula 22).

$$R=(\rho_{md}\times V_{md}\times A_d)/(C_r\times(2\times\Delta P_r/\rho_{1r})^{0.5}\times A_{vl}\times\rho_{1rl}+A_v\times(2/(\lambda+1))^{((\lambda+1)/2(\lambda-1))}\times(\lambda\times P_{1r}\times\rho_{1rg})^{0.5}) \quad \text{(Formula 23):}$$

The tolerable multiplying factor R for each of the refrigerants is obtained in accordance with (Formula 23), as exemplarily indicated in Table 5.

TABLE 5

Tolerable multiplier R for maximum tolerable air leakage rate Qv

| Tolerable average concentration | | ¼LFL | ¼LFL | ½LFL | ½LFL |
|---|---|---|---|---|---|
| Leakage height | | 2.2 m | 0.6 m | 2.2 m | 0.6 m |
| Refrigerant | R32 | 1.96 | 1.02 | 5.41 | 2.83 |
| | R1234yf | 3.57 | 1.84 | 9.76 | 5.10 |
| | R1234ze(E) | 4.33 | 2.26 | 11.98 | 6.26 |
| | R452B | 2.29 | 1.20 | 6.37 | 3.32 |
| | R454B | 2.28 | 1.19 | 6.33 | 3.31 |

(4-4-3)

Described above is calculation of the cutoff leakage rate and the like. Symbols and the like included in the formulae indicate as follows in (4-4-3-1) to (4-4-3-3) unless otherwise specified.

(4-4-3-1) Symbols

A: area ($m^2$ as unit)
C: flow rate coefficient
d: equivalent diameter (m as unit)
G: mass flow rate velocity ($kg\cdot s^{-1}$ as unit)
g: gravitational acceleration ($m\cdot s^{-2}$ as unit)
h: leakage height (m as unit)
L: refrigerant lower flammable limit (LFL) ($kg\cdot m^{-3}$ as unit)
N: refrigerant volume concentration (vol % as unit)
P: pressure (Pa as unit)
Q: volume flow rate velocity ($m^3\cdot s^{-1}$ as unit)
R: tolerable multiplier for valve leakage rate
Δp: differential pressure (Pa as unit)
S: safety coefficient
U: refrigerant molecular weight
v: velocity ($m\cdot s^{-1}$ as unit)
X: ratio of refrigerant leakage velocity at liquid-side cutoff valve to refrigerant leakage velocity at gas-side cutoff valve
Y: ratio of refrigerant leakage velocity at gas-side cutoff valve before change to refrigerant leakage velocity at gas-side cutoff valve after change (4-4-3-2) Greek Letters κ: air specific heat ratio
λ: refrigerant specific heat ratio
ρ: mass concentration ($kg\cdot m^{-3}$ as unit)

(4-4-3-3) Subscripts $_a$: air
$_d$: clearance below door
$_g$: gas phase
$_k$: liquid phase
$_m$: mixture of refrigerant and air
$_r$: refrigerant
$_s$: refrigerant leakage point
$_v$: cutoff valve
$_G$: gas-side line
$_L$: liquid-side line
$_1$: upstream
$_2$: downstream
$_{max}$: tolerance
$_0$: before change
$_{00}$: after change (5) Characteristics of Air Conditioner (5-1)

In "guideline of design construction for ensuring safety against refrigerant leakage from commercial air conditioners using mild flammability (A2L) refrigerants (JRA GL-16: 2017)", which is the guideline of The Japan Refrigeration and Air Conditioning Industry Association issued on Sep. 1, 2017, "Annex A (Prescription) Specifications of safety cutoff valves" is prepared. In "Annex A (Prescription) Specifications of safety cutoff valves", when the fluid is air and the differential pressure between upstream and downstream of each of the gas-side cutoff valve and the liquid-side cutoff valve is 1 MPa, 300 ($cm^3$/min) is prescribed as the cutoff leakage rate to be satisfied by the gas-side cutoff valve and the liquid-side cutoff valve.

The gas-side cutoff valve generally has a large valve diameter, and thus, the cutoff leakage rate at the same differential pressure tends to be high. On the other hand, the liquid-side cutoff valve generally has a small valve diameter, and the cutoff leakage rate at the same differential pressure tends to be low. In the above guideline, it is required to uniformly suppress the cutoff leakage rate to 300 ($cm^3$/min) or less regardless of the gas-side cutoff valve and the liquid-side cutoff valve. However, designing or selecting a gas-side cutoff valve having a valve diameter larger than the valve diameter of the liquid-side cutoff valve so that the cutoff leakage rate is equivalent to the cutoff leakage rate at the liquid-side cutoff valve leads to an increase in manufacturing or purchase costs.

The refrigerant leakage velocity assumed in the guideline can be calculated from the cutoff leakage rate prescribed in the above guideline. Further, as illustrated in FIG. 6, since the state of the target refrigerant is different, in the same valve clearance, the refrigerant leakage velocity at the liquid-side cutoff valve is higher than the refrigerant leakage velocity at the gas-side cutoff valve. In other words, when the cutoff leakage rate at the gas-side cutoff valve and the cutoff leakage rate at the liquid-side cutoff valve are the same as each other, the refrigerant leakage velocity at the liquid-side cutoff valve is higher than that at the gas-side cutoff valve, and thus a large amount of refrigerant leaks into the predetermined space.

In view of this, in one or more embodiments, the cutoff leakage rates at the gas-side cutoff valves 68*a*, 68*b*, 68*c*, and 68*d* are made higher than those at the liquid-side cutoff valves 71*a*, 71*b*, 71*c*, and 71*d*.

As a result, even in a case where the refrigerant leakage velocity at the gas-side cutoff valves 68*a*, 68*b*, 68*c*, and 68*d* increase, the refrigerant leakage velocity at the liquid-side cutoff valves 71*a*, 71*b*, 71*c*, and 71*d* decrease, such that it is possible to satisfy the cutoff leakage rate prescribed in the above guideline. Therefore, it is possible to reduce the manufacturing cost of the gas-side cutoff valves 68*a*, 68*b*, 68*c*, and 68*d* while ensuring safety.

(5-2)

In one or more embodiments, those at which the cutoff leakage rate is higher than 300×R ($cm^3$/min) are adopted as the gas-side cutoff valves 68*a*, 68*b*, 68*c*, and 68*d*. On the other hand, those at which the cutoff leakage rate is lower than 300×R ($cm^3$/min) are adopted as the liquid-side cutoff valves 71*a*, 71*b*, 71*c*, and 71*d*. Accordingly, it is possible to reduce the manufacturing cost of the gas-side cutoff valves 68*a*, 68*b*, 68*c*, and 68*d* while ensuring safety. Here, R calculated in (4-4) is taken into consideration when changing the cutoff leakage rates at the liquid-side cutoff valve and the gas-side cutoff valve. Therefore, it is possible to reduce the manufacturing cost of the gas-side cutoff valves 68*a*, 68*b*, 68*c*, and 68*d* while ensuring safety.

(5-3)

In the above guideline, it is required to uniformly suppress the cutoff leakage rates at the gas-side cutoff valve and the liquid-side cutoff valve to 300 ($cm^3$/min) or less. However, in this case, manufacturing or purchasing the gas-side cutoff valve having a relatively large valve diameter results in an increase in cost. Therefore, in one or more embodiments, the cutoff leakage rate at each of the gas-side cutoff valves 68*a*, 68*b*, 68*c*, and 68*d* and the liquid-side cutoff valves 71*a*, 71*b*, 71*c*, and 71*d* are changed from 300×R ($cm^3$/min) and designed or selected so that the refrigerant leakage velocities at the gas-side cutoff valves 68*a*, 68*b*, 68*c*, and 68*d* and the liquid-side cutoff valves 71*a*, 71*b*, 71*c*, and 71*d* are equivalent to the sum of the refrigerant leakage velocities in a case where the same valve clearance is assumed for both the gas-side cutoff valve and the liquid-side cutoff valve according to the above guideline.

According to the calculation shown in (4-3), when the cutoff leakage rates at the gas-side cutoff valves 68*a*, 68*b*, 68*c*, and 68*d* are changed to 1.0 times to 2.7 times or less of 300 ($cm^3$/min) and designed or selected, the cutoff leakage rates at the liquid-side cutoff valves 71*a*, 71*b*, 71*c*, and 71*d* are changed to 0.94 times or less of 300 ($cm^3$/min) and designed or selected.

R calculated in (4-4) is further considered for numerical values of the cutoff leakage rates at the gas-side cutoff valve and the liquid-side cutoff valve selected in this manner.

As described above, when the cutoff leakage rates at the gas-side cutoff valves are changed to 1.0 times to 2.7 times or less of 300×R ($cm^3$/min) and designed or selected, the cutoff leakage rates at the liquid-side cutoff valves 71*a*, 71*b*, 71*c*, and 71*d* are changed to 0.94 times or less of 300×R ($cm^3$/min) and designed or selected. At this time, the refrigerant leakage velocities at the gas-side cutoff valves 68*a*, 68*b*, 68*c*, and 68*d* and the liquid-side cutoff valves 71*a*, 71*b*, 71*c*, and 71*d* are equivalent to the sum of the refrigerant leakage velocities in a case where the same valve clearance is assumed for the gas-side cutoff valves 68*a*, 68*b*, 68*c*, and 68*d* and the liquid-side cutoff valves 71*a*, 71*b*, 71*c*, and 71*d* according to the above guideline.

In this manner, even when the cutoff leakage rates at the gas-side cutoff valves 68*a*, 68*b*, 68*c*, and 68*d* exceed the cutoff leakage rate of 300 ($cm^3$/min) prescribed in the above guideline, the cutoff leakage rates at the liquid-side cutoff valves 71*a*, 71*b*, 71*c*, and 71*d* are designed or selected so as to compensate for the exceeding cutoff leakage rate. As a result, it is possible to suppress an increase in cost for manufacturing or purchase of the gas-side cutoff valves 68*a*, 68*b*, 68*c*, and 68*d* while ensuring safety.

More appropriately, the liquid-side cutoff valves 71*a*, 71*b*, 71*c*, and 71*d* are designed or selected so that when the cutoff leakage rates at the gas-side cutoff valves 68*a*, 68*b*, 68*c*, and 68*d* are in a range of 1.6 times to 2.7 times of 300×R ($cm^3$/min), the cutoff leakage rates at the liquid-side cutoff valves 71*a*, 71*b*, 71*c*, and 71*d* are in a range of 0.37 times to 0.94 times of 300×R ($cm^3$/min).

(5-4)

In the air conditioner 1, the maximum cutoff leakage rate required for the cutoff valve is calculated in the manner mentioned above in (4-3) to (4-4-2) in accordance with the conditions such as the size of the room (predetermined space) SP equipped with the utilization-side units 3*a*, 3*b*, 3*c*, and 3*d* (the size of the clearance UC below the door DR or the height of the ceiling), the type of the refrigerant (R32), and the places equipped with the utilization-side units 3*a*, 3*b*, 3*c*, and 3*d* (installed at the ceiling instead of being placed on the floor), to determine the specifications of the liquid-side cutoff valves 71*a*, 71*b*, 71*c*, and 71*d* and the gas-side cutoff valves 68*a*, 68*b*, 68*c*, and 68*d*. Specifically, calculated is the multiplying factor R for 300 ($cm^3$/min) as a reference value of the cutoff leakage rate in the specifications prescribed by the Annex A of the guideline, as to how much the tolerable rate can be increased for 300($cm^3$/min). The specific numerical value of the multiplying factor R is obtained as indicated in Table 5. Herein, in the case where R32 is adopted as the refrigerant, the utilization-side units 3*a*, 3*b*, 3*c*, and 3*d* are installed at the ceiling of the room SP, and the safety coefficient S is set to 4, the multiplying factor R is 1.96 as indicated in Table 5.

In accordance with the multiplying factor R, the specifications of the liquid-side cutoff valves 71*a*, 71*b*, 71*c*, and 71*d* and the gas-side cutoff valves 68*a*, 68*b*, 68*c*, and 68*d* are determined in the air conditioner 1 so that the maximum cutoff leakage rate is 300×1.96 ($cm^3$/min) or less. In comparison to the case where the specifications are determined in accordance with 300 ($cm^3$/min) as the reference value, the liquid-side cutoff valves 71*a*, 71*b*, 71*c*, and 71*d* and the gas-side cutoff valves 68*a*, 68*b*, 68*c*, and 68*d* are reduced in manufacturing cost or purchase cost, to reduce introduction cost for the air conditioner 1 using the refrigerant (R32) capable of preventing global warming.

Also in the air conditioner 1 including the liquid-side cutoff valves 71*a*, 71*b*, 71*c*, and 71*d* and the gas-side cutoff valves 68*a*, 68*b*, 68*c*, and 68*d* having the specifications thus determined, quantity of the refrigerant flowing out of the room SP through the valve clearance of each of the liquid-side cutoff valve 71*a* and the gas-side cutoff valve 68*a* after the air conditioner 1 stops in Step S7 in FIG. 5 is suppressed to allow the refrigerant concentration to be kept sufficiently lower than the LFL in the room SP.

(5-5)

The multiplying factor R for calculating how much the tolerable rate can be increased for the reference value of the cutoff leakage rate such as 300 ($cm^3$/min) in the specification prescribed in the Annex A of the above guideline is determined based on at least one of the tolerable average concentration, the leakage height, or the type of the refrigerant.

As described in (4-4-1-A), the leakage height is the position of the first portion in the predetermined space SP when the refrigerant leaks into the predetermined space SP. The leakage height is 2.2 m or the like when the utilization-side unit is installed at the ceiling and is 0.6 m or the like when the utilization-side unit is placed on the floor (see IEC60335-2-40: 2016).

As described in (4-4-1-B), the tolerable average concentration is an average concentration of the refrigerant leaking into the predetermined space SP, and is a refrigerant concentration in a range where it is recognized that there is no risk of combustion of the refrigerant leaking into the predetermined space SP. The tolerable average concentration is obtained by dividing the LFL by the safety factor.

The type of the refrigerant refers to the type of the refrigerant belonging to any of the following: a mildly flammable refrigerant determined as "Class 2L" according to ANSI/ASHRAE Standard 34-2013; a less flammable refrigerant determined as "Class 2" according to ANSI/ASHRAE Standard 34-2013; and a highly flammable refrigerant determined as "Class 3" according to ANSI/ASHRAE Standard 34-2013.

The multiplying factor R is determined based on at least any one of these, and, specifically, has a numerical value in a range of 1.02 to 11.98 as shown in Table 5. As a result, the specification of the cutoff leakage rate to be satisfied by the gas-side cutoff valve and the liquid-side cutoff valve can be obtained.

(5-6)

It is also possible to design or select the gas-side cutoff valves 68*a*, 68*b*, 68*c*, and 68*d* and the liquid-side cutoff valves 71*a*, 71*b*, 71*c*, and 71*d* by simply calculating the cutoff leakage rates at the gas-side cutoff valves 68*a*, 68*b*, 68*c*, and 68*d* and the liquid-side cutoff valves 71*a*, 71*b*, 71*c*, and 71*d* with R of 1 (R=1) without calculating the numerical value of the multiplying factor R as described above in consideration of a case where the predetermined space SP does not have the clearance UC below the door DR.

(6) Modified Example (6-1)

The air conditioner 1 according to the embodiments described above is installed in a room (predetermined space SP) of an architecture such as a building. When the air conditioner 1 is installed in a space in a different architecture, designing or selection of the specifications of the cutoff valve may be changed in accordance with conditions of the predetermined space SP. Appropriate cutoff valves can be designed or selected for various spaces such as a space in a plant, a kitchen, a data sensor, a computer room, and a space in a commercial facility.

(6-2)

The above embodiments exemplify R32 as the refrigerant circulating in the refrigerant circuit 10 of the air conditioner 1. When another flammable refrigerant is adopted, the multiplying factor R is calculated in accordance with a difference in condition such as a refrigerant molecular weight or the LFL as described above, for designing or selection of specifications of the liquid-side cutoff valves 71*a*, 71*b*, 71*c*, and 71*d* and the gas side cutoff valves 68*a*, 68*b*, 68*c*, and 68*d* appropriate for the multiplying factor R.

(6-3)

The above embodiments exemplify the control flow illustrated in FIG. 5 as the operation of the air conditioner 1 upon refrigerant leakage. The air conditioner 1 can alternatively adopt different operation as operation upon refrigerant leakage. Alternatively, pumping down operation may be performed upon detection of refrigerant leakage, and the cutoff valve may then be controlled to be closed.

(6-4)

In the above embodiments, in Step S4 and Step S5, the utilization-side units 3*a*, 3*b*, 3*c*, and 3*d* perform the cooling operation and the heat source-side expansion valve 25 is decreased in opening degree to decrease a pressure of the refrigerant flowing to the utilization-side units 3*a*, 3*b*, 3*c*, and 3*d*. This control is merely exemplary and may alternatively be replaced with different control.

Upon detection of refrigerant leakage into the predetermined space SP equipped with the utilization-side unit 3*a*, only the liquid-side cutoff valve 71*a* and the gas-side cutoff valve 68*a* of the relay unit 4*a* corresponding to the utilization-side unit 3*a* may alternatively be closed immediately.

Upon detection of refrigerant leakage into the predetermined space SP equipped with the utilization-side unit 3*a*, there may still alternatively be adopted control to close all the liquid-side cutoff valves 71*a*, 71*b*, 71*c*, and 71*d* and the gas-side cutoff valves 68*a*, 68*b*, 68*c*, and 68*d* to separate all the utilization-side units 3*a*, 3*b*, 3*c*, and 3*d* from the heat source-side unit 2, as well as stopping the compressor 21 of the heat source-side unit 2.

(6-5)

The above embodiments exemplify, as the utilization-side unit, the utilization-side units 3*a*, 3*b*, 3*c*, and 3*d* installed to be buried in the ceiling. The cutoff valve is designed or selected in a similar manner even with any utilization-side unit in a different form. The multiplying factor R can be obtained in accordance with (Formula 23) even when the utilization-side unit is of a ceiling pendant type, of a floor placement type, of a wall mounted type to be mounted on a side wall, or the like.

(6-6)

The gas-side cutoff valve generally has a large valve diameter, and thus, the cutoff leakage rate at the same differential pressure tends to be high. On the other hand, the liquid-side cutoff valve generally has a small valve diameter, and the cutoff leakage rate at the same differential pressure tends to be low. Therefore, in the above embodiments, it has been assumed that the valve diameters of the gas-side cutoff valves 68*a*, 68*b*, 68*c*, and 68*d* are larger than the valve diameters of the liquid-side cutoff valves 71*a*, 71*b*, 71*c*, and 71*d*. However, even in a case where the valve diameters of the liquid-side cutoff valves 71*a*, 71*b*, 71*c*, and 71*d* are equal to or larger than the valve diameters of the gas-side cutoff valves 68*a*, 68*b*, 68*c*, and 68*d*, the cutoff leakage rates at the gas-side cutoff valves 68*a*, 68*b*, 68*c*, and 68*d* are made higher than the cutoff leakage rate prescribed in the above guideline, and the cutoff leakage rates at the liquid-side cutoff valves 71*a*, 71*b*, 71*c*, and 71*d* are made lower than the cutoff leakage rate prescribed in the above guideline, such that the refrigerant leakage velocity can be suppressed to be equal to or lower than the refrigerant leakage velocity assumed in the above guideline. In addition to a mode in which the gas-side cutoff valves 68*a*, 68*b*, 68*c*, and 68*d* and the liquid-side cutoff valves 71*a*, 71*b*, 71*c*, and 71*d* are installed one by one, a mode in which two gas-side cutoff valves and one liquid-side cutoff valve are installed is also conceivable.

(6-7)

In one or more embodiments, the cutoff leakage rates at the gas-side cutoff valves 68*a*, 68*b*, 68*c*, and 68*d* and the liquid-side cutoff valves 71*a*, 71*b*, 71*c*, and 71*d* are evaluated using "air" as the gas that is in the single gas phase in the standard state. However, the gas for evaluating the cutoff leakage rate is not limited to "air", and may be any type of gas that is in the single gas phase in the standard state, including "nitrogen" and the like.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: air conditioner (refrigerant cycle apparatus)
3*aa*, 3*bb*, 3*cc*, 3*dd*: first portion (utilization-side circuit)
10: refrigerant circuit
19: control unit
68*a*, 68*b*, 68*c*, 68*d*: gas-side cutoff valve
71*a*, 71*b*, 71*c*, 71*d*: liquid-side cutoff valve
79*a*, 79*b*, 79*c*, 79*d*: detection unit (refrigerant leakage detection unit)
SP: predetermined space

The invention claimed is:

1. A refrigerant cycle apparatus that circulates a flammable refrigerant in a refrigerant circuit, the refrigerant cycle apparatus comprising:
a gas-side cutoff valve;
a liquid-side cutoff valve, where the gas-side cutoff valve and the liquid-side cutoff valve are disposed on opposite sides of a first portion of the refrigerant circuit;
a sensor that detects refrigerant leakage from the first portion into a predetermined space; and
a controller that sets a cutoff state in the gas-side cutoff valve and the liquid-side cutoff valve when the sensor detects the refrigerant leakage from the first portion into the predetermined space, wherein
a cutoff leakage rate at the gas-side cutoff valve is a leakage rate of air when a temperature is 20° C. and a predetermined differential pressure of 1 MPa exists between an upstream side and a downstream side of the gas-side cutoff valve in the cutoff state,
a cutoff leakage rate at the liquid-side cutoff valve is a leakage rate of air when the temperature is 20° C. and the predetermined differential pressure of 1 MPa exists between an upstream side and a downstream side of the liquid-side cutoff valve in the cutoff state, and
the cutoff leakage rate at the gas-side cutoff valve is higher than the cutoff leakage rate at the liquid-side cutoff valve.

2. The refrigerant cycle apparatus according to claim 1, wherein
the cutoff leakage rate at the gas-side cutoff valve is greater than 300×R ($cm^3$/min), and
the cutoff leakage rate at the liquid-side cutoff valve is less than 300×R ($cm^3$/min),
where R is a multiplying factor.

3. The refrigerant cycle apparatus according to claim 1, wherein
the cutoff leakage rate at the gas-side cutoff valve is greater than or equal to 1.0 times of 300×R ($cm^3$/min) and less than or equal to 2.7 times of 300×R ($cm^3$/min), and
the cutoff leakage rate at the liquid-side cutoff valve is less than or equal to 0.94 times of 300×R ($cm^3$/min),
where R is a multiplying factor.

4. The refrigerant cycle apparatus according to claim 1, wherein
the cutoff leakage rate at the gas-side cutoff valve is greater than or equal to 1.6 times of 300 x R ($cm^3$/min) and less than or equal to 2.7 times of 300×R ($cm^3$/min), and
the cutoff leakage rate at the liquid-side cutoff valve is greater than or equal to 0.37 times of 300×R ($cm^3$/min) and less than or equal to 0.94 times of 300×R ($cm^3$/min),
where R is a multiplying factor.

5. The refrigerant cycle apparatus according to claim 2, wherein R=1.

6. The refrigerant cycle apparatus according to claim 2, wherein the multiplying factor R is calculated for each of the gas-side cutoff valve and the liquid-side cutoff valve, and $$R=(\rho_{md}\times V_{md}\times A_d)/(C_r\times(2\times\Delta P_r/\rho_{1r})^{0.5}\times A_v\times\rho_{1rl}+A_v\times(2/(\lambda+1))^{((\lambda+1)/2\ (\lambda-1))}\times(\lambda\times P_{1r}\times\rho_{1rg})^{0.5}),\text{ in which}$$

$A_v$ is a valve clearance sectional area ($m^2$) of the corresponding gas-side cutoff valve or the corresponding liquid-side cutoff valve in the cutoff state,
p1rl is a density ($kg/m^3$) of the refrigerant in a liquid phase,
P1rg is a density ($kg/m^3$) of the refrigerant in a gas phase,
P1r is a pressure (MPa) of the refrigerant located upstream of the corresponding gas-side cutoff valve or the corresponding liquid-side cutoff valve,
γis a specific heat ratio of the refrigerant,
$p_{md}$ is a density ($kg/m^3$) of the gaseous mixture of the air and the refrigerant passing through a clearance of a door that partitions an inside and an outside of the predetermined space,
$V_{md}$ is a velocity (m/s) of the gaseous mixture of the air and the refrigerant passing through the clearance of the door that partitions the inside and the outside of the predetermined space,
$A_d$ is an area ($m^2$) of the clearance of the door that partitions the inside and the outside of the predetermined space,
$\Delta P_r$ is a pressure difference (Pa) between an inside and an outside of a hole where the refrigerant leaks, and
$C_r$ is a flow rate coefficient of the refrigerant when the refrigerant in the liquid phase passes through the hole where the refrigerant leaks, and is 0.6.

7. The refrigerant cycle apparatus according to claim 2, wherein
a tolerable average concentration is an average concentration of the refrigerant leaking into the predetermined space, and is in a range where there is no risk of combustion of the refrigerant leaking into the predetermined space,
a leakage height is a position of the first portion in the predetermined space when the refrigerant leaks into the predetermined space, and
R is determined based on at least one of the tolerable average concentration, the leakage height, or a type of the refrigerant.

8. The refrigerant cycle apparatus according to claim 1, wherein the flammable refrigerant is one selected from a group comprising:
a "Class 2L" mildly flammable refrigerant according to ANSI/ASHRAE Standard 34-2013,
a "Class 2L" less flammable refrigerant according to ANSI/ASHRAE Standard 34-2013, and
a "Class 3" highly flammable refrigerant according to ANSI/ASHRAE Standard 34-2013.

* * * * *